US010246247B2

(12) United States Patent
Godfroid et al.

(10) Patent No.: US 10,246,247 B2
(45) **Date of Patent: *Apr. 2, 2019**

(54) BASE FOR CONTAINER OF A VISCOUS PRODUCT AND A PROPELLANT

(71) Applicant: Frito-Lay North America, Inc., Plano, TX (US)

(72) Inventors: Robert Godfroid, McKinney, TX (US); Galina Laufer, Plano, TX (US); David Michael Pehar, Willoughby, OH (US); John Evan Spirk, Gates Mills, OH (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/478,818

(22) Filed: Apr. 4, 2017

(65) Prior Publication Data

US 2017/0203909 A1 Jul. 20, 2017

Related U.S. Application Data

(63) Continuation of application No. 14/686,449, filed on Apr. 14, 2015, now Pat. No. 9,637,301.

(51) Int. Cl.
*B65D 83/38* (2006.01)
*B65D 83/14* (2006.01)
(Continued)

(52) U.S. Cl.
CPC ..... *B65D 83/38* (2013.01); *B65D 83/206* (2013.01); *B65D 83/40* (2013.01); *B65D 83/46* (2013.01); *B65D 83/56* (2013.01); *B65D 83/752* (2013.01)

(58) Field of Classification Search
CPC .. B85D 83/388; B85D 83/205; B85D 83/206; B85D 83/38; B85D 83/40; B85D 83/46; B85D 83/56; B85D 83/752
(Continued)

(56) References Cited

U.S. PATENT DOCUMENTS 3,946,911 A * 3/1976 Morane ..... B65D 83/206 222/402.11
5,702,036 A * 12/1997 Ferrara, Jr. ..... B65D 83/206 222/402.13
(Continued)

OTHER PUBLICATIONS

Lingle, R., "Hellmann's squeezes improvements out of mayo bottle" Mar. 24, 2015, http://www.packagingdigest.com/food-packaging/hellmanns-squeeze-bottles-out-of-mayo-bottle1503, 6 pages.

*Primary Examiner* — Lien Ngo
(74) *Attorney, Agent, or Firm* — Brandon V. Zuniga; Colin P. Cahoon; Carstens & Cahoon, LLP

(57) ABSTRACT

A method and apparatus for storing and dispensing a viscous product. The product and a propellant are stored in a container on a base, and the propellant forms a head space. In a storage configuration, the container rests on the base, the base rests on a surface, and the propellant in the head space and the product tend to move toward positions wherein the propellant in the head space is at a higher elevation than the product and the product is at a higher elevation than an inlet to a dispenser. In one aspect, the base comprises a first portion, a second portion comprising a lid, a sidewall comprising a window, and an interior. In a second aspect, the method comprises storing the container in the storage configuration, removing the lid to expose a dispenser, dispensing the product, and viewing an interior of the base through the window.

37 Claims, 16 Drawing Sheets

(51) Int. Cl.

| | |
|---|---|
| ***B65D 83/56*** | (2006.01) |
| ***B65D 83/40*** | (2006.01) |
| ***B65D 83/20*** | (2006.01) |
| ***B65D 83/46*** | (2006.01) |

(58) Field of Classification Search
USPC ..... 222/402.21, 402.22, 402.13, 402.1, 222/402.11, 153.1, 153.11, 153.13, 181.1, 222/181.2, 185.1
See application file for complete search history.

(56) References Cited

U.S. PATENT DOCUMENTS

| | | | | |
|---|---|---|---|---|
| 7,882,990 | B1 * | 2/2011 | Walters | B65D 83/206 222/185.1 |
| 8,733,599 | B2 * | 5/2014 | Hornland | B65D 83/205 222/135 |
| 2005/0017026 | A1 * | 1/2005 | Yerby | B65D 83/20 222/402.13 |

* cited by examiner

BASE FOR CONTAINER OF A VISCOUS PRODUCT AND A PROPELLANT

CROSS-REFERENCE AND RELATED APPLICATIONS

This application is a continuation patent application of co-pending U.S. Ser. No. 14/686,449 entitled "Base for Container of a Viscous Product and a Propellant" filed on Apr. 14, 2015, published as Publication Number US 2016/0304270 A1, published on Oct. 20, 2016, which is hereby incorporated by reference in its entirety as an example.

BACKGROUND OF THE INVENTION

Technical Field

The present invention relates to storing a viscous product and a propellant in a container and using the propellant (e.g., pressurized gas) to dispense the product from a dispenser located at the bottom of the container.

Background

Viscous products (e.g., syrups, foods, beverages, purees, sauces, dips, frosting, whipped cream, soft cheese, and oil) are desirable to many consumers. Additionally, foamed products can be especially desirable due to their texture (e.g., light mouthfeel), their ability to provide a greater volume of product with fewer calories, and their ability to provide a more satisfying consumption experience. For example, a typical foamed product can comprise about 30% to about 75% gas by volume, which can reduce calories by 75% compared to the same volume of a non-foamed product.

However, many of the advantages of a foamed product are lost if the foam is lost. Thus, the inventors have sought to provide a better storage and delivery system for foamed products that helps to preserve the foam. As the inventors conducted their work, they realized that certain containers were not feasible for storing foamed products. For example, the inventors determined that storing foamed product in a typical jar (e.g., mason jar) is thermodynamically unstable. When using a typical jar, it is practically impossible to maintain a desired amount of gas in the foamed product for its intended shelf life and for a period of time during which the product is intended to be consumed. For example, the loss of foam can be especially acute after a consumer opens ajar.

Because foam in a jar is thermodynamically unstable, it is desirable to store foamed products using a different storage device. One example is an aerosol container in which a pressurized gas is stored with a liquid product. When the liquid product is dispensed its pressure drop across a dispenser valve causes the dissolved gas in the product to come out of solution and form a foam, resulting in a foamed product.

Aerosol containers are advantageous because they can be used to maintain satisfactory levels of dissolved gas (e.g., aeration) over a shelf life and a subsequent period of consumption. Accordingly, product can be dispensed from an aerosol container to form a foamed product.

However, providing a foamed product using aerosol technology can be problematic. The technology typically involves a beverage component, liquid food component, or solid food component (e.g., whipped cream, syrup, sauce, batter, or dip) and a pressurized gas propellant (e.g. air, nitrous oxide and/or carbon dioxide) in the same container. The container is stored sitting on its bottom end, which comprises a base. Meanwhile, the top end, which has a valve for dispensing product, is pointed up. In this condition, some of the gas phase propellant will naturally rise to the top of the container to form a pressurized, gaseous head space. When the container is later turned upside-down to dispense product, some of the propellant in the headspace can be trapped near the valve by the viscous, liquid/solid product phase. Then, when the valve is actuated, propellant from the head space exits without any product. As a result, product can be stranded in the container without sufficient propellant to ever be dispensed.

Accordingly, it would be advantageous to provide a method and apparatus for storing and dispensing foamed products that helps to prevent or avoid dispensing propellant from the head space before the product phase has been dispensed. It would also be advantageous if the method and apparatus prevented or avoided stranding product in an aerosol container. For example, it would be beneficial if the invention could maintain a product between a head space and a dispenser of the aerosol container.

It would also be advantageous if the method and apparatus facilitated the storage, delivery, cooking, and serving of a more convenient food product. For example, it would be desirable if the invention helped enable consumers to avoid messy preparations of a product (e.g., preparing pancake batter) by giving consumers access to foamed versions of the product. As another example, it would be beneficial if the invention made it easier to deliver a single pancake or cupcake serving for cooking without wasting ingredients that are not easily subdivided, such as eggs or liquid-ingredient packets. It would also be beneficial if the invention facilitated delivering a single serving of a product without having to calculate the necessary proportion of ingredients from a recipe intended to produce more servings.

Additionally, it would be useful if the invention could help reduce the formulation cost of a product by facilitating the storage and delivery of a foamed version of the product. For example, it would be advantageous if the foamed version of the product reduced the cost per volume of the product in a way that still satisfied consumers. It would also be advantageous if the foamed product enabled consumers to choose more expensive ingredients, higher quality ingredients, healthier ingredients, or less processed ingredients, while paying the same or less for a given volume of product.

As another benefit, it would be useful if some embodiments of the invention could be used with existing containers of product and propellant that consumers have already purchased. For example, it could be beneficial if the invention comprised a base could be used with common aerosol container shapes, or if the base could be used with specifically shaped containers that a particular manufacturer has already produced.

It would also be useful if some embodiments of the invention comprised a base with a proprietary fitting so that the dispenser could not be used easily with differently branded products. For example, this could help prevent brand-related confusion among consumers due to the base from one manufacturer being used with products and/or containers from another manufacturer.

Similarly, it would be advantageous if the invention provided a lid to keep the dispenser clean. For example, it would be beneficial if the lid could be used to separate a dispenser from a supporting surface upon which the base rests. It would also be beneficial if the lid could prevent tainting of the product, contamination of the dispenser, dripping of the product onto the supporting surface and/or leakage of the product onto the supporting surface (e.g., a display shelf, refrigerator shelf, or countertop). It would also be advantageous if the invention had a safety feature to prevent the dispenser from being actuated if the lid were in place.

Additionally, it would be advantageous if the invention provided a more ergonomic and sanitary option for dispensing product. For example, the tilt valves that are typically used with aerosol containers are actuated directly by a user's finger. As a result, a user's finger can become tired or strained by repeated or lengthy use, and if a user has not sanitized the finger, bacteria, viruses, or other pathogens on the finger can be left behind on the dispenser and/or be mixed into product when it is dispensed. Accordingly, it would also be advantageous if the invention provided an actuator (e.g., trigger) and a base configured to facilitate easier dispensing and dosing of a product. Likewise, it would be advantageous if the base comprised a material that were sufficiently flexible and resilient to serve as an actuator. It would also be advantageous if the base and actuator could be integral, for example, if the entire base were manufactured in a single mold using an injection molding process.

As another advantage, it would be useful if the invention comprised a base that could be made from a material that is sufficiently durable to be used successively with multiple containers. It would also be useful if the base were made from a material that is sufficiently environmentally friendly (e.g., biodegradable) and/or sufficiently inexpensive that the base would be practical even if it were only used once.

Furthermore, it would be advantageous if the invention included an opening, transparent portion, and/or translucent portion in the base to facilitate viewing a target of the dispensed product and to facilitate clean-up after dispensing the product.

Likewise, it would be beneficial if one embodiment of the invention conserved packaging material and reduced production costs while providing a base of that is large enough to provide a stable support surface for a container. For example, it would be advantageous if the invention provided a base that was sufficiently large to maintain a container in a desired storage configuration. However, it would also be advantageous if the base were smaller at the top and then got larger toward the bottom so that the amount of material used could be reduced relative to a more uniformly shaped base.

SUMMARY OF THE INVENTION

In a first aspect, the presently disclosed invention provides a method for storing and dispensing a viscous product. The product and a propellant are stored in a container on a base, and the propellant forms a head space. The method comprises storing the container in a storage configuration on the base, removing a lid from the base to expose a dispenser, and dispensing the product. Furthermore, in the storage configuration, the container rests on the base, the base rests on a surface, and the product and the propellant in the head space tend to move toward positions wherein the propellant in the head space is at a higher elevation than the product and the product is at a higher elevation than an inlet to the dispenser.

In a second aspect, the presently disclosed invention provides a method for storing and dispensing a viscous product. The product and a propellant are stored in a container on a base, and the propellant forms a head space. The method comprises storing the container in a storage configuration on the base, dispensing the product, and viewing an interior of the base through a window in a sidewall of the base. The window provides a line of sight from a point outside the base to the interior of the base. Furthermore, in the storage configuration, the container rests on the base, the base rests on a surface, and the product and the propellant in the head space tend to move toward positions wherein the propellant in the head space is at a higher elevation than the product and the product is at a higher elevation than an inlet to a dispenser.

In a third aspect, the presently disclosed invention provides a base for a container of a viscous product and a propellant. The propellant forms a head space. When the base and the container are in a storage configuration, the propellant in the head space and the product tend to move toward positions wherein the propellant in the head space is at a higher elevation than the product and the product is at a higher elevation than an inlet to a dispenser. The base comprises a first portion of the base, a second portion of the base, a sidewall between a first end of the base and an integral second end of the base, and an interior of the base. The first portion of the base comprises a first end of the base, and the first end of the base comprises a first opening of the base. The second portion of the base comprises an integral second end of the base, the integral second end of the base is opposite the first end of the base, and the integral second end of the base comprises a second opening of the base. The sidewall comprises an interior surface of the sidewall, and the sidewall comprises a window positioned to provide a line of sight from a point outside the base to the interior of the base. The interior of the base comprises the interior surface of the sidewall and any point between two points on the interior surface of the sidewall.

In a fourth aspect, the presently disclosed invention provides a base for a container of a viscous product and a propellant. The propellant forms a head space. When the base and the container are in a storage configuration, the propellant in the head space and the product tend to move toward positions wherein the propellant in the head space is at a higher elevation than the product and the product is at a higher elevation than an inlet to a dispenser. The base comprises a first portion of the base, a second portion of the base, a sidewall between a first end of the base and an integral second end of the base, and an interior of the base. The first portion of the base comprises a first end of the base, and the first end of the base comprises a first opening of the base. The second portion of the base comprises an integral second end of the base and a lid. The integral second end of the base is opposite the first end of the base, and the integral second end of the base comprises a second opening of the base. The sidewall comprises an interior surface of the sidewall. The interior of the base comprises the interior surface of the sidewall and any point between two points on the interior surface of the sidewall.

In a fifth aspect, the presently disclosed invention provides a base for a container for storing a viscous product and a propellant. The propellant forms a head space. The container comprises a first portion and a second portion opposite the first portion of the container, and the second portion of the container comprises a dispenser. When the base and the container are in a storage configuration, the second portion of the container is adjacent to the base, the container rests on the base, the base rests on a surface, and the product and the propellant in the head space tend to move toward positions wherein the propellant in the head space is at a higher elevation than the product and the product is at a higher elevation than an inlet to the dispenser. The base comprises: a first portion of the base comprising a first end of the base; a second portion of the base comprising an integral second end of the base; a sidewall; an interior of the base; and an actuator for the dispenser. The integral second end of the base is opposite the first end of the base. The sidewall is between the first end of the base and the integral second end of the base, and the sidewall comprises an interior surface of the sidewall. The interior of the base comprises the interior surface of the sidewall and any point between two points on the interior surface of the sidewall. The first end of the base comprises a first opening of the base. The integral second end of the base comprises a second opening of the base.

In a sixth aspect, the presently disclosed invention provides a method for storing and dispensing a viscous product. The product and a propellant are stored in a container on a base, and the propellant forms a head space. The container comprises a first portion and a second portion opposite the first portion of the container. The second portion of the container comprises a dispenser. The container is configured to dispense the product when the propellant in the head space is at a higher elevation than the product and the product is at a higher elevation than an inlet to the dispenser. The base comprises a first portion, a second portion opposite the first portion of the base, a sidewall, an interior of the base, and an actuator for the dispenser. The first portion of the base comprises a first end of the base. The second portion of the base comprises an integral second end of the base. The integral second end of the base is opposite the first end of the base. The sidewall is between the first end of the base and the integral second end of the base. The sidewall comprises an interior surface of the sidewall. The interior of the base comprises the interior surface of the sidewall and any point between two points on the interior surface of the sidewall. The method comprises storing the container in a storage configuration on the base and pressing the actuator on the base to actuate the dispenser and thereby dispense the product. In the storage configuration, the container rests on the base, the base rests on a surface, and the product and the propellant in the head space tend to move toward positions wherein the propellant in the head space is at a higher elevation than the product and the product is at a higher elevation than the inlet to the dispenser.

The presently disclosed invention encompasses many different variations and embodiments, which provide various advantages, respectively. To help illustrate the advantages provided by the invention, several examples are listed below.

For example, the invention provides a method and apparatus for storing and dispensing foamed products and helps to prevent or avoid dispensing propellant from the headspace before the product phase has been dispensed. The method and apparatus also prevents or avoids stranding product in an aerosol container, for example, by maintaining the product between a head space and a dispenser of the aerosol container.

The invention also provides a method and apparatus that facilitates the storage, delivery, cooking, and serving of a more convenient food product. For example, the invention helps enable consumers to avoid messy preparations of a product (e.g., preparing pancake batter) by giving consumers access to foamed versions of the product. As another example, the invention makes it easier to deliver a single pancake or cupcake serving for cooking without wasting ingredients that are not easily subdivided, such as eggs or liquid-ingredient packets. The invention also facilitate delivering a single serving of a product without having to calculate the necessary proportion of ingredients from a recipe intended to produce more servings.

Additionally, the invention helps reduce the formulation cost of a product by facilitating the storage and delivery of a foamed version of the product. For example, the foamed version reduces the cost per volume of the product while still satisfying consumers. The foamed product also enables consumers to choose more expensive ingredients, higher quality ingredients, healthier ingredients, or less processed ingredients, while paying the same or less for a given volume of product.

As another benefit, the invention can be used with existing containers of product and propellant that consumers have already purchased. For example, the invention comprises a base that can be used with common aerosol container shapes. As another example, the invention comprises a base that can be used with specifically shaped containers that a particular manufacturer has already produced.

The invention also provides for a base with a proprietary fitting so that the dispenser cannot be used easily with differently branded products. For example, this helps prevent brand-related confusion among consumers due to the base from one manufacturer being used with products and/or containers from another manufacturer.

As another benefit, the invention provides for a lid to keep the dispenser clean. For example, the lid can be used to separate a dispenser from a supporting surface upon which the base rests. The lid can also prevent tainting of the product, contamination of the dispenser, dripping of the product onto the supporting surface and/or leakage of the product onto the supporting surface (e.g., a display shelf, refrigerator shelf, or countertop). The invention also provides for a safety feature to prevent the dispenser from being actuated if the lid is in place.

Additionally, the invention provides a more ergonomic and sanitary option for dispensing product. For example, the tilt valves that are typically used with aerosol containers are actuated directly by a user's finger. As a result, a user's finger can become tired or strained by repeated or lengthy used, and if a user has not sanitized the finger, bacteria, viruses, or other pathogens on the finger can be left behind on the dispenser and/or be mixed into product when it is dispensed. Accordingly, the invention advantageously provides an actuator (e.g., trigger) and a base configured to facilitate easier dispensing and dosing of a product. As another advantage, the invention provides for a base comprising a material that is sufficiently flexible and resilient to serve as an actuator. Furthermore, the invention provides for an actuator that is integral with a base. For example, the entire base, including the actuator, can be manufactured in a single mold using an injection molding process.

As another advantage, the invention provides for a base that can be made from a material that is sufficiently durable to be used successively with multiple containers. The base can also be made from a material that is sufficiently environmentally friendly (e.g., biodegradable) and/or sufficiently inexpensive for the base to be practical even if it is only used once.

Furthermore, the invention provides for a base comprising an opening, transparent portion, and/or translucent portion to facilitate viewing a target of the dispensed product and to facilitate clean-up after dispensing the product.

As another benefit, the invention the invention provides for conserving packaging material and reducing production costs while providing a base that is large enough to provide a stable support surface for a container. For example, the invention provides a base that is sufficiently large to maintain a container in a desired storage configuration. Advantageously, the invention also provides for a base that is smaller at the top and gets larger toward the bottom to reduce the amount of material used in comparison to a more uniformly shaped base.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Figure 1A:
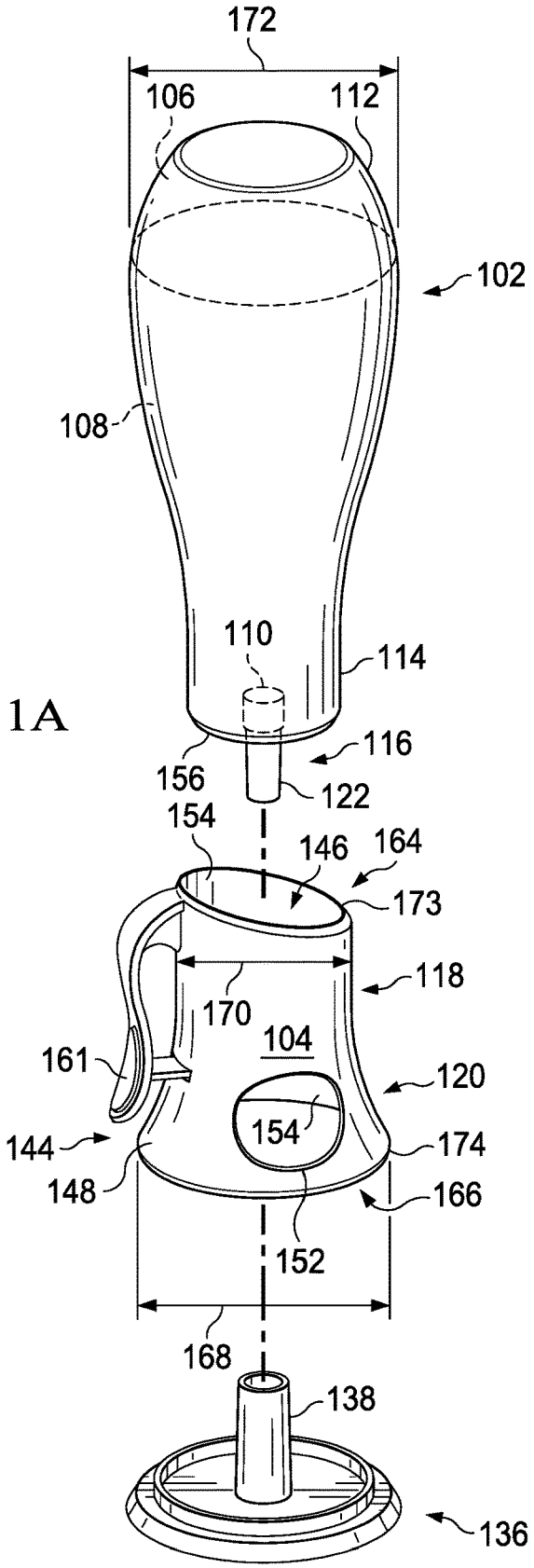
FIG. 1A is a schematic illustration of one embodiment of the invention depicting a container separated from a base and depicting the base separated from a lid.

Generally speaking, aerosol technology involves a container 102 (e.g., can) that stores a propellant (e.g., a pressurized gas in a head space 106) and a product 108 (e.g., liquid phase, solid phase, or mixed liquid solid phase) under pressure (e.g., around 150 psig). For example, in some embodiments, about 10% by mass of the propellant is dissolved in the product 108 as a dissolved gas (e.g., an aerating gas). As the product 108 and dissolved gas pass a valve 110, the dissolved gas comes out of solution and forms bubbles as the dissolved gas expands to a lower pressure. This, in turn, can provide a foamed product 108*a*, for example, as shown in FIG. 5B.

While inside the container, some of the propellant is dissolved in the product phase, but about 90% by mass of the propellant is undissolved and remains in a head space 106 (e.g., gas phase separate from the product phase.) Since the undissolved propellant is less dense than the product 108, when the container 102 is sitting on a first portion 112 of the container 102, the propellant rises to a second portion of a container 102 that is opposite the first portion.

For many containers, when the container is sitting on its bottom (e.g., first portion 112 for the container 102 in FIG. 1A) a dispenser 116 for the valve 110 is located at the top of the container (e.g., second portion 114 for the container 102 in FIG. 1A). Accordingly, in order to dispense product 108 and any dissolved propellant rather than undissolved propellant from the head space 106, the container 102 must be tipped upside down. However, in some cases (e.g., when the product 108 is a viscous product), the product 108 takes a significant amount of time to reach a dispenser 116 at the top end of an inverted container 102. As examples, a viscous product can have a viscosity of about 1 cP to about 250,000 cP, about 1000 cP to about 250,000 cP, about 2000 cP to about 250,000, or about 60,000 cP to about 250,000. If the dispenser 116 is actuated to dispense the contents (e.g., product and/or propellant) of the container 102 before the product phase has settled into a position next to the valve 110, the undissolved propellant, rather than the product phase, will be dispensed. If too much propellant escapes before the product 108 is completely dispensed, some of the product 108 may be stranded in the container 102.

Because foamed products tend to be viscous, unintentionally dispensing propellant from the head space 106 and stranding the product 108 in the container 102 is a fairly common problem with foamed products. However, various embodiments of the present invention can be used to address this and other problems.

An embodiment of the invention will now be described with reference to FIG. 2, which illustrates a method for storing and dispensing a viscous product 108 and FIGS. 1A-1E, which depict one embodiment of the invention. The viscous product 108 (e.g., pancake batter or whipped cream) and a propellant (e.g. nitrous oxide and/or carbon dioxide) are stored in a container 102 on a base 104. The base 104 comprises a first portion 118 (e.g., top portion when the base 104 is in a storage configuration as shown in FIG. 1C) and a second portion 120 (e.g., bottom portion when the base 104 is in a storage configuration as shown in FIG. 1C). The second portion 120 of the base is opposite the first portion 118 of the base. As illustrated, for example, in FIG. 6A, the first portion 118 of the base 104 comprises a first end 173 of the base, and the second portion 120 of the base comprises a second end 174 of the base. Additionally, the first end 173 of the base 104 can be opposite the second end 174 of the base.

Similarly, the container 102 comprises a first portion 112 (e.g., top portion when the container 102 is in a storage configuration as shown in FIG. 1C) and a second portion 114 (e.g., bottom portion when the container 102 is in a storage configuration as shown in FIG. 1C). In the embodiment shown, the second portion 114 of the container 102 is opposite the first portion 112 of the container. Additionally, the second portion 114 of the container 102 comprises a dispenser 116.

The container 102 is configured to dispense product 108 when an inlet 132 to the dispenser 116 is at a lower elevation than the product 108, and the product 108 is at a lower elevation than the propellant in the head space 106. FIGS. 1D-1E show examples of dispensing configurations. As shown in FIG. 1D, the container 102 can be inverted (e.g., oriented upside down or tilted with the nozzle 122 away from vertical 124). However, as shown in FIG. 1E, the container 102 can also be at any angle of tilt 126 away from vertical 124 that provides a product level 130 (e.g., interface between the product phase and the propellant in the head space 106) that is higher than the inlet 132 to the dispenser 116. In some embodiments, as illustrated in FIG. 1E, depending on the shape of the container 102, the container 102 is in a dispensing configuration even when the container 102 is not inverted.

Various changes to the shape of a uniform container can help to increase the angle of tilt 126 at which the container 102 is in a dispensing configuration, even when the nozzle 122 is pointed above horizontal 128. For example, relative to a more uniformly shaped container with a nozzle 122 pointed above horizontal 128, if the container 102 has a wide first portion 112 and narrow second portion 114, the height of the product level 130 above the inlet 132 to the dispenser 116 can be increased for a given angle of tilt 126. Alternatively, relative to a more uniformly shaped container, the container 102 comprising a wide first portion 112 and narrow second portion 114 can enable a greater angle of tilt 126 while maintaining the container 126 in a dispensing configuration where the height of the product level 130 remains above the inlet 132 to the dispenser 116.

Figure 2:
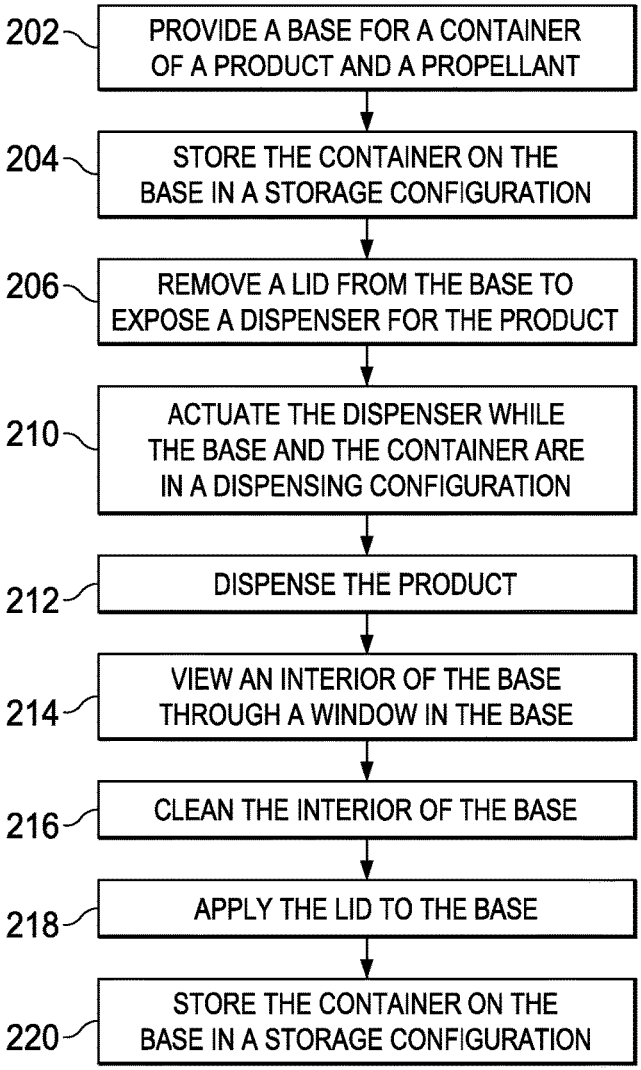
FIGS. 2-3 are flow charts depicting steps for various embodiments of the invention.

With reference to FIG. 2, one embodiment of the invention comprises several steps. First in a providing step 202, the base 104 is provided for the container 102.

Second, in a container storing step 204, the container 102 is stored in a storage configuration relative to the base 104. FIG. 1C shows as an example of a storage configuration, with the second portion 114 of the container 102 is adjacent to the first portion 118 of the base 104. As illustrated, the container 102 can be stored on top of the base 104 in an inverted or upside down orientation (e.g., with the dispenser 116 pointing down). When the container 102 is in the storage configuration, the container 102 rests on the base 104 and the base 104 rests on a supporting surface 134. Additionally, if the product 108 and the propellant in the head space 106 are not already in a state of static equilibrium so that the product 108 is at a lower elevation than the propellant in the head space 106 (e.g., similar to the state shown in FIG. 1C), a force of gravity moves the product 108 and the propellant toward the state of static equilibrium. Accordingly, when one embodiment is in the storage configuration, the product 108 and propellant tend to move toward positions wherein the propellant in the head space 106 is at a higher elevation than the product and the product is at a higher elevation than an inlet 132 to the dispenser 116.

Third, in a lid 136 removing step 206, a lid 136 (e.g., the lid 136 shown in FIG. 1B) is removed from the base 104 to expose the dispenser 116 for the product 108. In some embodiments, the lid 136 is provided with or comprises a tamper-evident seal to indicate that the container 102 has not been opened since it was manufactured. Accordingly, in some embodiments, before or during removal of the lid 136 by a consumer, the tamper-evident seal is moved into a configuration indicating that the container 102 has been opened. For example, the tamper evident seal is broken. In some embodiments, the lid 136 is provided with or comprises an anti-tamper mechanism, for example, a child proof mechanism, to prevent children from opening the container 102. Furthermore, the base 104 (e.g., the lid 136) can comprise an anti-tamper seal, which must be removed or disengaged before the lid 136 is removed from the base 104. Examples of tamper-evident seals include a piece of tape, a heat shrink plastic band with perforations, and molded tabs. For example, the tamper-evident seal can be located where the lid 136 meets with the base 104, and the tamper-evident seal can be configured to break when the lid is removed from the base. Additionally, the tamper-evident seal can be located on the outside of the base 104 so it is readily visible to a consumer.

In some embodiments, a safety mechanism is disengaged when the lid 136 is removed. For example, the lid 136 can comprise a safety mechanism 138 that prevents a product dispenser 116 from being actuated. Accordingly, in some embodiments, removing the lid 136 disengages the safety mechanism 138. As an example of a safety mechanism 138, the lid 136 can comprise a safety sheath 138 that covers the nozzle 122 of a tilt valve 110 and prevents the nozzle 122 from being laterally displaced and thereby dispensing the contents of the container 102. When the lid 136 is removed, the safety sheath 138 is disengaged (e.g., it is positioned so that it no longer prevents the nozzle 122 from being tilted or laterally displaced). Accordingly, the dispenser 116 can be actuated and the contents (e.g., product 108 and/or propellant) of the container 102 can be dispensed. In some embodiments, a safety mechanism 138 can be used with a tamper-evident or anti-tamper seal.

Figure 5A:
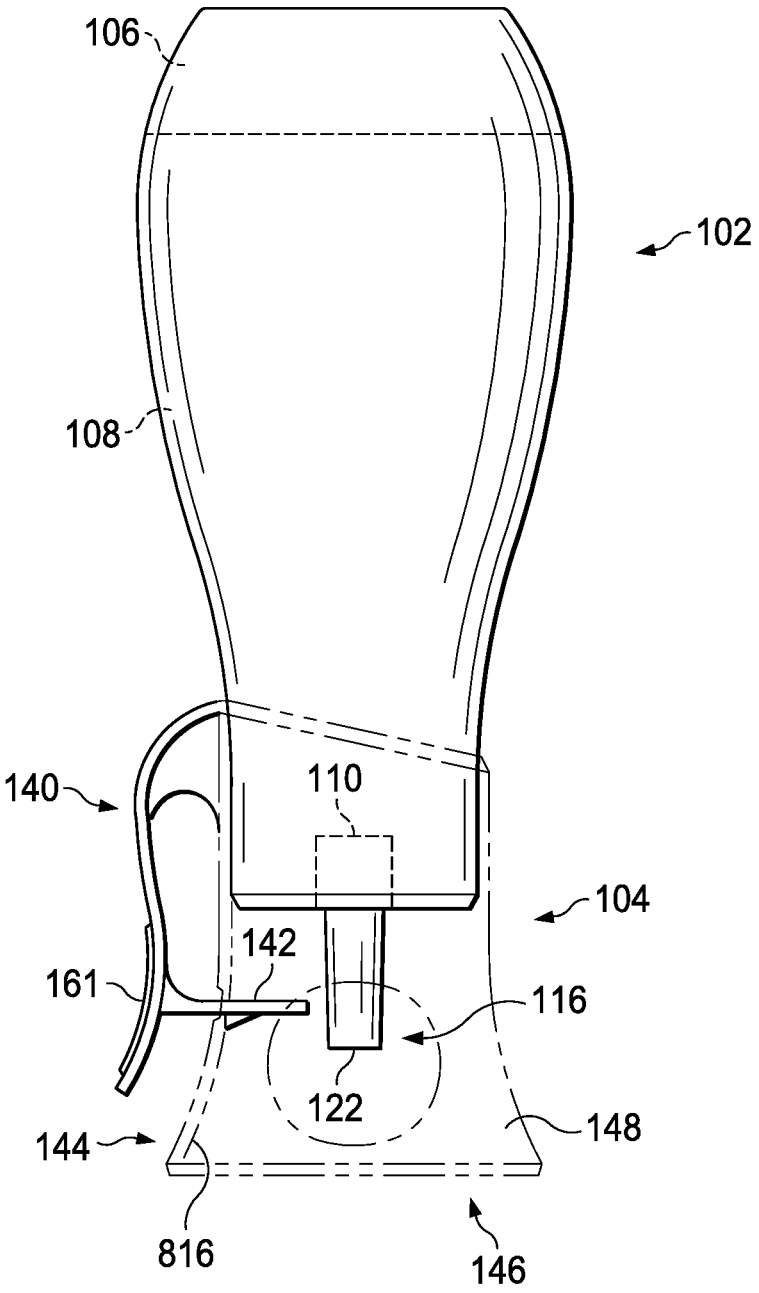
FIG. 5A is a schematic illustration of one embodiment of the invention depicting a dispenser in a non-actuated configuration.
Figure 5B:
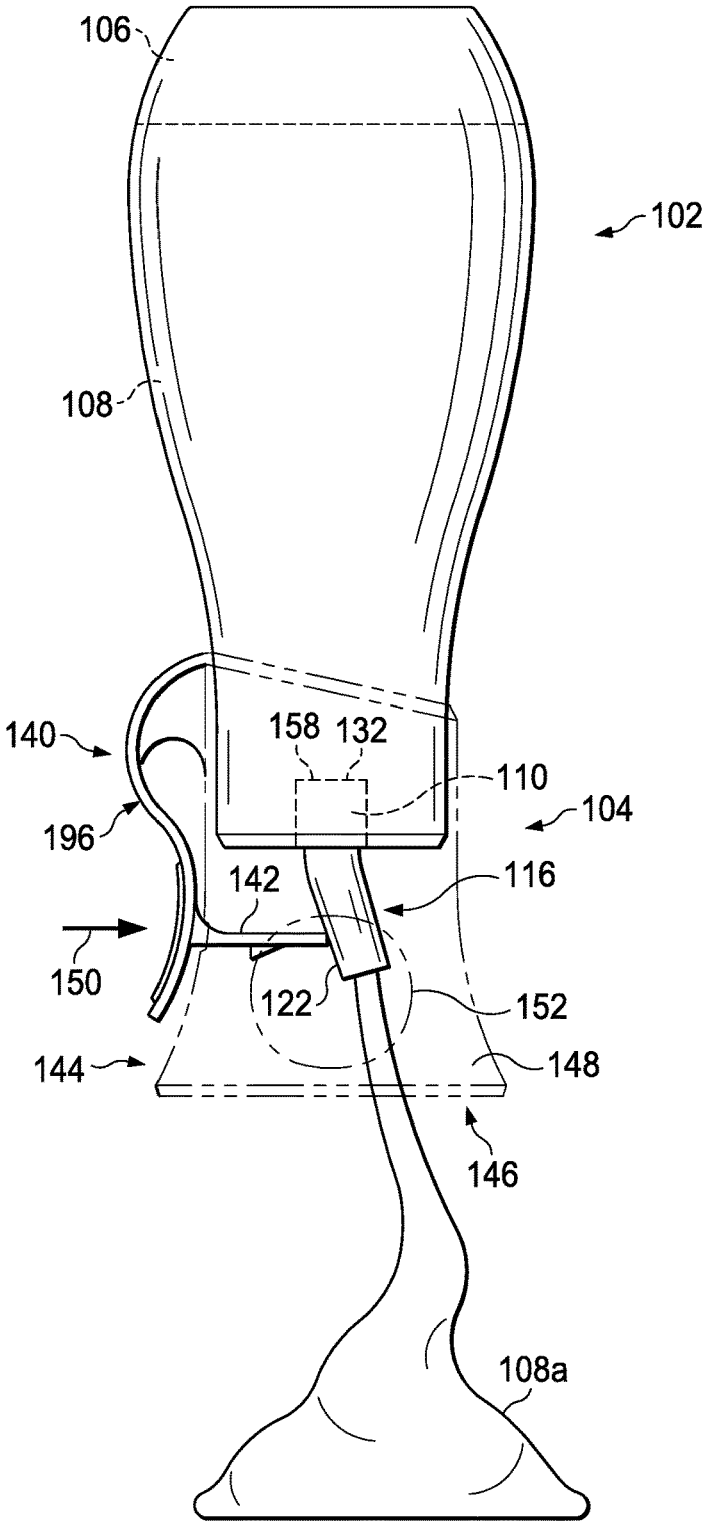
FIG. 5B is a schematic illustration of one embodiment of the invention depicting a dispenser in an actuated configuration.

Fourth, in an actuating step 210 illustrated in FIGS. 5A-5B, the dispenser 116 is actuated while the base 104 and the container 102 are in a dispensing configuration. In one embodiment, the actuating step comprises actuating the dispenser 116 by pressing an actuator 140 on the base 104. For example, in one embodiment, pressing the actuator 140 moves the actuator 140 into contact with the nozzle 122 of a tilt valve 110, and the contact causes tilt (e.g., lateral displacement) in the nozzle 122, which in turn actuates the valve 110 to dispense the contents of the container 102 (e.g., product 108 and/or propellant). In one embodiment, an extension 142 of the actuator 140 extends from an exterior 144 of the base 104, through a sidewall 148 of the base 104, and into the interior 146 of the base 104. In a disengaged configuration (e.g., position and/or orientation), the extension 142 does not displace the nozzle 122 of the title valve 110. However, upon actuation, the extension 142 moves (e.g., in an actuating direction 150) into an engaged configuration in which the extension 142 contacts the nozzle 122 of the tilt valve 110 and displaces the nozzle 122 to cause sufficient tilt to dispense the contents of the container 102. In some embodiments, the actuator 140 on the base 104 is positioned and oriented to be actuated when a user squeezes (e.g., manually) the actuator 140.

Fifth, in a dispensing step 212 illustrated in FIG. 5B, foamed product 108*a* is dispensed from the container 102 through the dispenser 116. In one embodiment, the container 102 is in a dispensing configuration when the foamed product 108*a* is dispensed. For example, the container 102 is in an inverted or upside down orientation with the nozzle 122 pointed down. In some embodiments, the container 102 need not be in an inverted position to dispense the product. For example, the product 108 can be dispensed as a foam 108*a* when an inlet 132 to the dispenser 116 is at a lower elevation than the product 108 and the product 108 is at a lower elevation than the propellant in the head space 106.

Sixth, in a viewing step 214, an interior 146 of the base 104 is viewed through a window 152 in the base 104 (e.g., as shown in FIG. 5B). In one embodiment, the window 152 provides a line of sight from the exterior 144 of the base 104 to the interior 146 of the base 104. In one embodiment, the invention comprises lighting an interior 146 of the base 104 through a window 152 in a sidewall 148 of the base 104. The form of the window 152 can be selected, for example, from the group consisting of an opening and a transparent portion. In one embodiment, the entire base 104 is transparent and/or translucent (see, e.g., FIGS. 5A-5B). In one embodiment, the base 104 is generally transparent (e.g., made from polypropylene ("PP"), polystyrene ("PS"), polyethylene terephthalate ("PET"), poly(methyl methacrylate) ("PMMA")) or translucent (e.g., made from polyethylene ("PE"), PP, polyvinyl chloride ("PVC"), acrylonitrile butadiene styrene ("ABS"), PS, PET, Nylon, PMMA, blends thereof, or another polymeric material) and the base 104 comprises a window 152 (e.g., opening). In another embodiment, the base 104 is generally translucent and the base 104 comprises a window 152 (e.g., opening or transparent portion). As examples, the transparent portion can be made from PP, PS, PET, or PMMA. In one embodiment, the base comprises a plurality of windows 152.

Seventh, in a cleaning step 216, an interior 146 of the base 104 is cleaned. In one embodiment, the cleaning step comprises cleaning (e.g., manually) an interior 146 of the base 104 through an opening (e.g., opening 152 in FIG. 5A) in a sidewall 148 of the base 104. As used in this context, the term "interior of the base" includes, for example, surfaces facing the interior 146 of the base 104 (e.g., an interior surface 154 of the base 104 or a surface 156 of the container 102 facing the interior 146 of the base 104) and surfaces positioned within the interior 146 of the base 104 (e.g., portions of the container, such as the dispenser nozzle 122, that protrude into the interior 146 of the base 104). In one embodiment, the cleaning step comprises cleaning an interior 146 of the base 104 through an opening 152 in the second portion 120 (e.g., bottom portion) of the base 104. In one embodiment, cleaning and lighting the interior 146 of the base 104 occur simultaneously. For example, a window 152 in a sidewall 148 can provide light to the interior 146 of the base 104 while the interior is cleaned. A window 152 can also provide a line of sight to view a portion of the interior 146 of the base 104 while the portion is being cleaned. Accordingly, in some embodiments, a user views the interior 146 of the base 104 through a window 152 in the sidewall 148 while cleaning the interior 146 of the base 104.

Figure 6A:
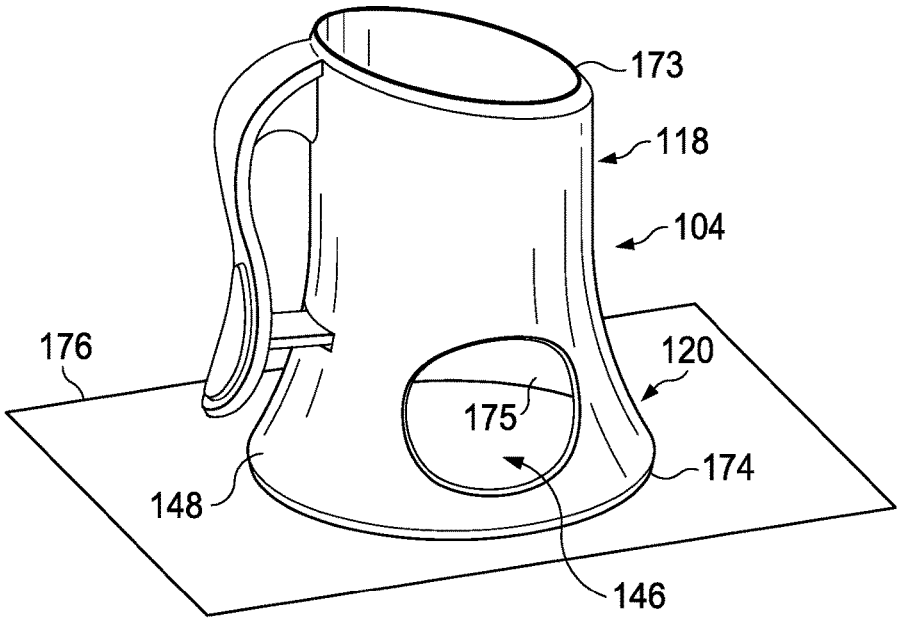
FIG. 6A is a schematic illustration of one embodiment of the invention depicting a base with a continuous bottom end and depicting a plane for taking a cross-section of the bottom end.

In one embodiment, for example, as shown in FIG. 6A, a sidewall 148 is located between a first end 173 of the base 104 and a second end 174 of the base, and the sidewall comprises an interior surface 175. In one embodiment, the interior 146 of the base 104 comprises the interior surface 175 of the sidewall 148 and a volume generally encompassed by the side wall. For example, the interior 146 of the base 104 can include any point between two points on the interior surface 175 of the sidewall 148.

Figure 1B:
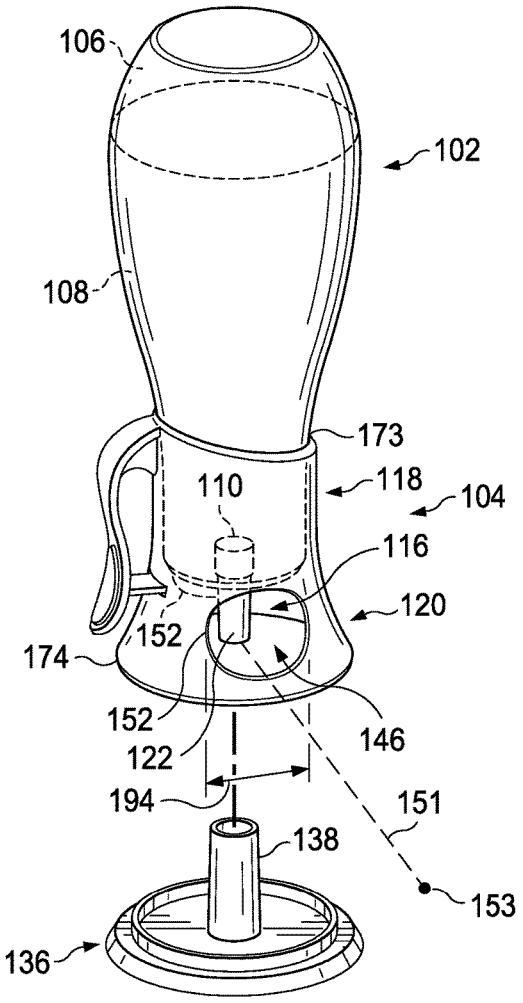
FIG. 1B is a schematic illustration of one embodiment of the invention depicting a container joined to a base and a base separated from a lid.
Figure 1C:
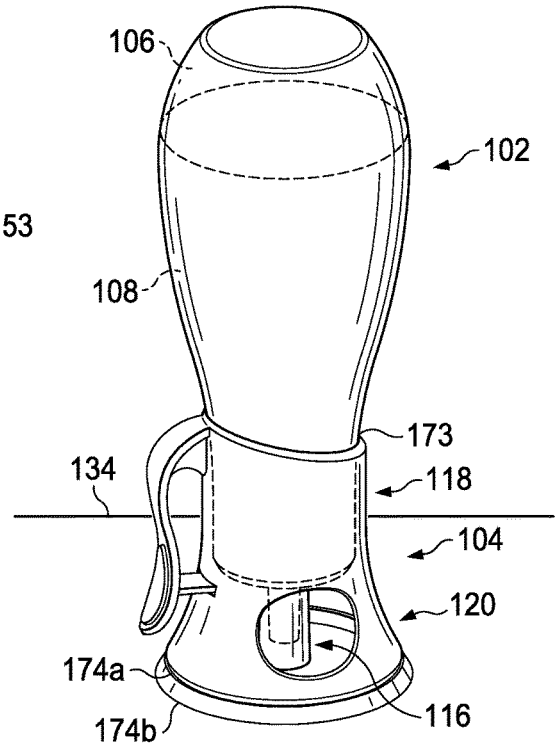
FIG. 1C is a schematic illustration of one embodiment of the invention depicting a container joined to a base and a base joined to a lid.
Figure 1D:
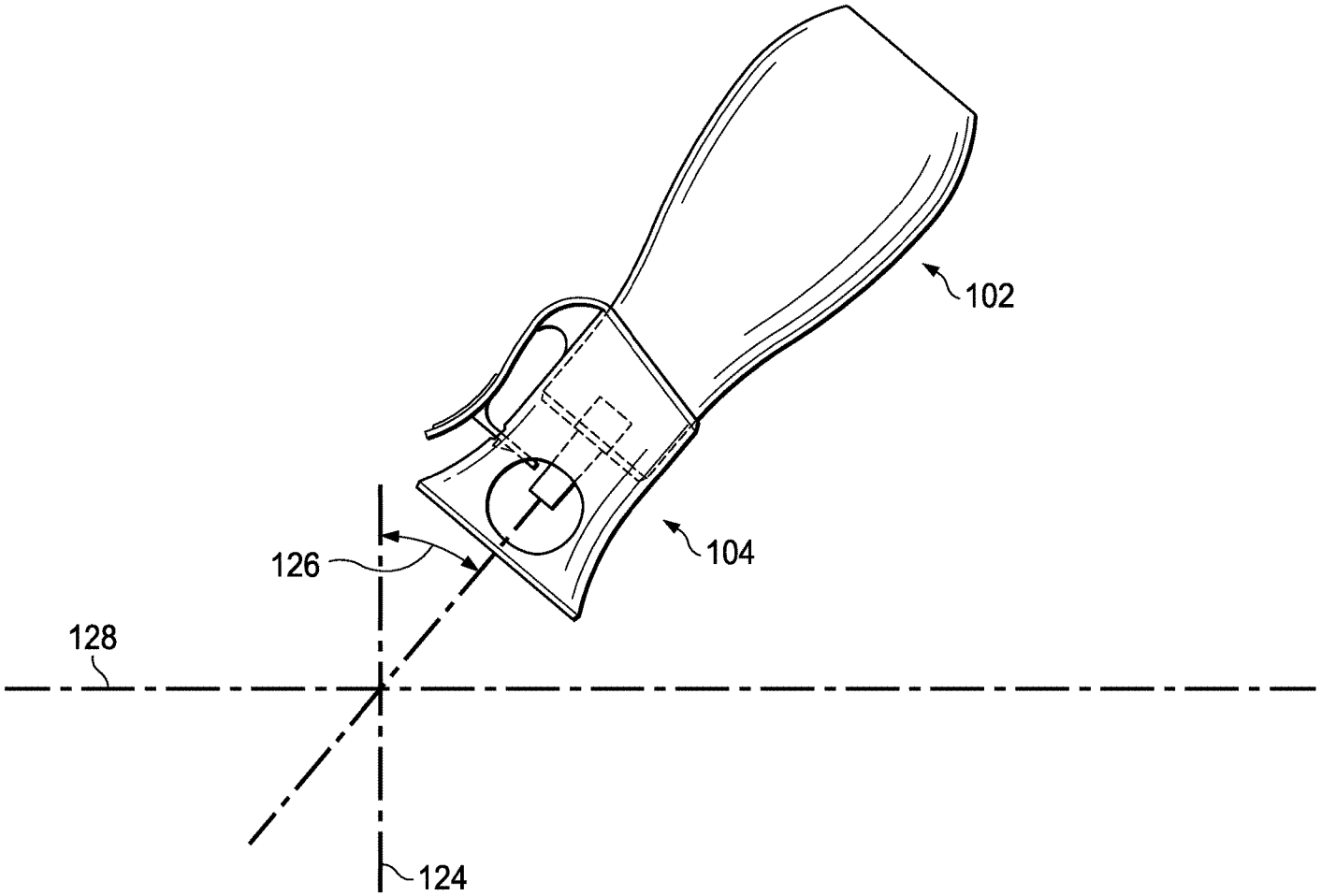
FIG. 1D-1E are schematic illustrations of one embodiment of the invention depicting a container joined to a base and depicting the container and base in various dispensing configurations and at various angles of tilt.
Figure 1E:
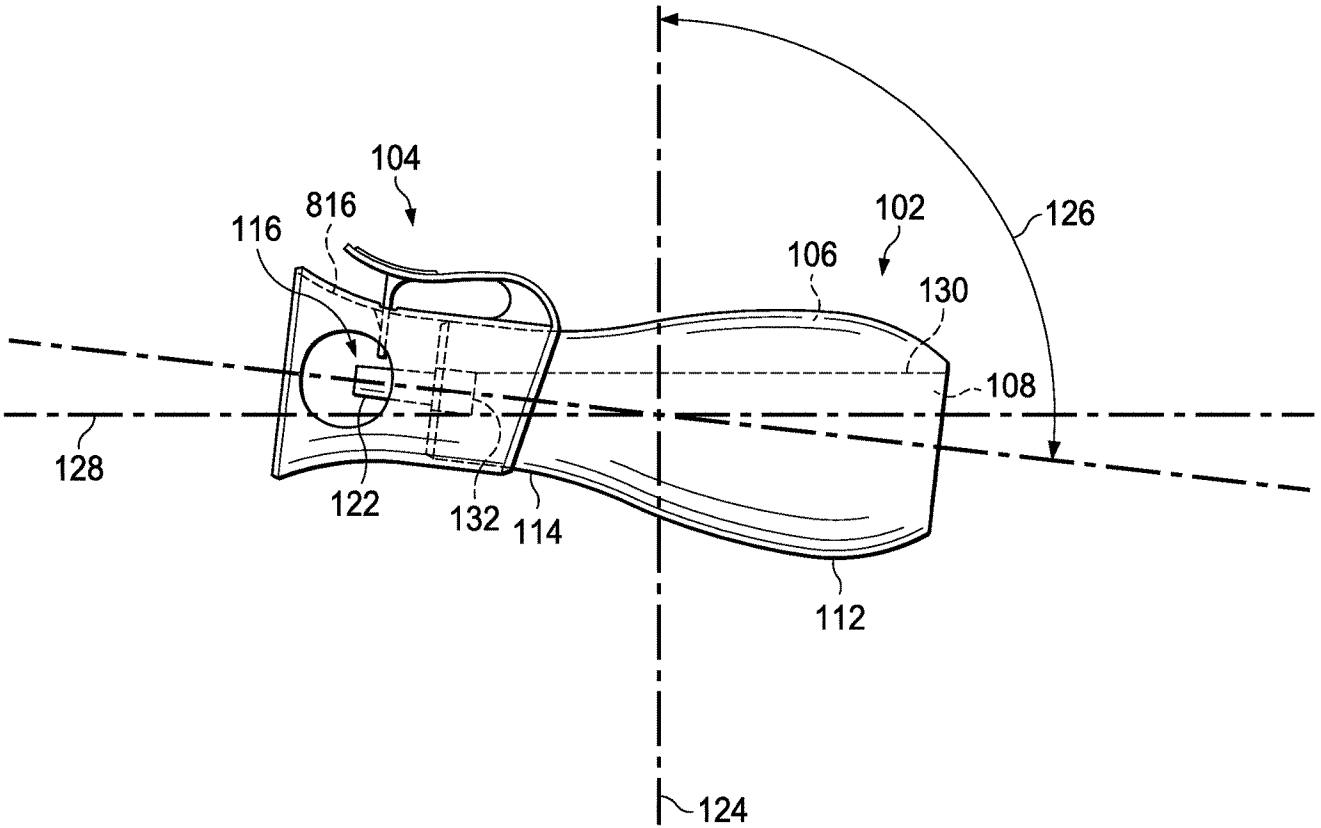

Eighth, in a lid 136 applying step 218 as illustrated in FIGS. 1B and 1C, the lid 136 is applied to the base 104. For example, the lid 136 can be applied to the second portion 120 (e.g., integral second end 174*a*) of the base. In one embodiment, the invention also comprises engaging a safety mechanism 138 for the base 104. Engaging the safety mechanism 138 can prevent product 108 from being dispensed by preventing a dispenser 116 from being actuated. For example, the nozzle 122 of a tilt valve 110 can be positioned in a safety sheath 138, which prevents the nozzle 122 from being tilted and prevents the dispenser from being actuated. In some embodiments, the lid 136 comprises a safety mechanism 138 (e.g., a safety sheath 138), and the safety mechanism 138 is engaged when the lid 136 is applied to the base 104. In other embodiments, the lid 136 comprises the safety mechanism 138, but the safety mechanism 138 is engaged separately from applying the lid 136.

Ninth, in a storing step 220, the container 102 is stored on the base 104 in a storage configuration, for example, as illustrated in FIG. 1C. In one embodiment the invention comprises positioning the container 102 on the base 104 (e.g., in an inverted orientation) and positioning the base 104 on a supporting surface 134.

Figure 3:
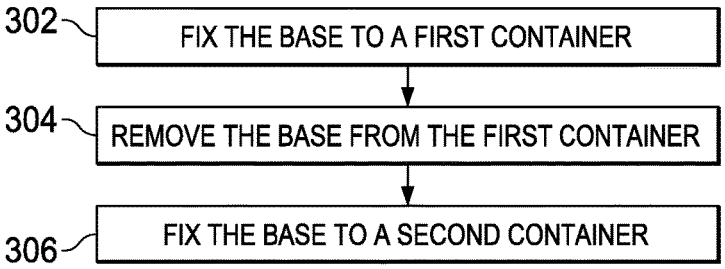

With reference to FIG. 3, some embodiments of the invention comprise steps for using a base 104 with multiple containers 102. For example, first, in a first fixing step 302, a multi-use base 104 is fixed to a first container 102. Second, in a removing step 304, the base 104 is removed from the first container 102. Third, in a second fixing step 306, the base 104 is fixed to a second container 102.

In some embodiments, when the base 104 is a multi-use base 104, the base 104 comprises a durable, flexible, inexpensive material (e.g., PE, PP, PVC, ABS, PS, PET, Nylon, PMMA, blends thereof, or another polymeric material) that is suitable for reuse of the subsequent container 102. The same materials that are used for a multi-use base can be used for a single-use base. Although, constructing the base from an inexpensive material can be especially useful when the base 104 is a single-use base 104. Additionally, when the base 104 is a single-use base, it can comprise a material that is less durable than the material used for the multi-use base 104. Furthermore, in some embodiments, the multi-use base is thicker or sturdier than the single-use base, as the multi-use base must withstand more wear and tear.

Although the invention is described herein with respect to specific method steps in a specific order, in some embodiments steps are added or omitted and the order of the steps is modified. For example, the viewing step 214 and the cleaning step 216 can be omitted. As another example, in some embodiments, the dispensing step 212 and viewing step 214 occur simultaneously.

One embodiment of the invention will now be described with reference to FIGS. 1A-1E, which illustrate a base 104 for a container 102 of a viscous product 108 and a propellant. The container 102 comprises a first portion 112 and a second portion 114, and the second portion 114 of the container 102 comprises a dispenser 116. As shown for example, in FIGS. 1E and 5B, the container 102 is configured to dispense the product 108 when the container is in a dispensing configuration. In the dispensing configuration, an inlet 132 to the dispenser 116 is at a lower elevation than the product 108 and the product 108 is at a lower elevation than the propellant in the head space 106. As shown in FIG. 1C, when the base 104 and the container 102 are in a storage configuration (e.g., a product storage configuration for storing product), the container 102 rests on the base 104, and the base 104 rests on a supporting surface 134. Additionally, when the base 104 and the container 102 are in the storage configuration, if the product 108 and the propellant are not already in a state of static equilibrium so that the product 108 is at a lower elevation than the propellant in the head space 106, a force of gravity moves the product 108 and the propellant in the head space 106 toward the state of static equilibrium. In one embodiment, if the container 102 is not in a dispensing configuration (e.g., as illustrated in FIGS. 1E and 5B), product 108 will not be dispensed (except, perhaps, for some product 108 already present in the dispenser 116). Instead, propellant or nothing will be dispensed. Furthermore, after the propellant from the head space 106 is completely or substantially completely dispensed, nothing or only a small amount of product 108 will be dispensed because the product 108 is insufficiently pressurized.

Figure 5C:
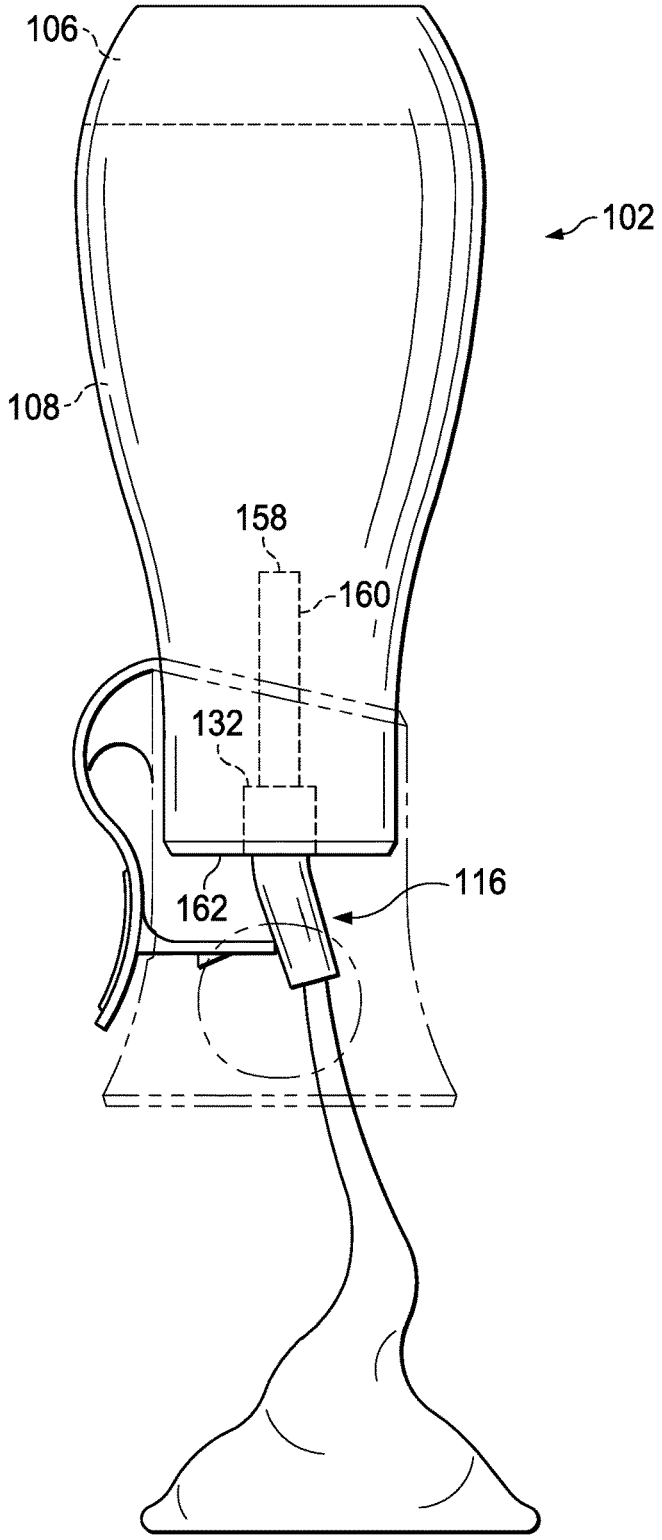
FIG. 5C is a schematic illustration of one embodiment of the invention depicting a dispenser with a feed tube so that an intake point for the dispenser through the feed tube can be located remotely from an inlet for the dispenser without a feed tube.

As shown in FIG. 5B, both an intake point 158 for the dispenser 116 and an inlet 132 for the dispenser 116 are located in the second portion 114 of the container 102 (e.g., at the bottom of the container). In other embodiments, for example, as shown in FIG. 5C, the dispenser 116 comprises a feed tube 160 so that the intake point 158 can be located remotely from the inlet 132 for the dispenser 116. For example, locating the intake point 158 above the bottom end 162 of the container 102 could be useful if a solid component of the product 108 tended to settle to the bottom end 162 of the container 102.

Turning to the illustration shown in FIG. 1A, in one embodiment, the base 104 comprises a first portion 118 (e.g., top portion), a second portion 120 (e.g., bottom portion), a sidewall 148, an interior 146, and an exterior 144. The first portion 118 of the base 104 comprises a first opening 164 (e.g., top opening), the second portion 120 of the base 104 comprises a second opening 166 (e.g., bottom opening), and the sidewall 148 comprises a window 152 positioned to provide a line of sight from the exterior 144 of the base 104 to the interior 146 of the base 104. In one embodiment, the first end 173 of the base 104 comprises the first opening 164 (e.g., top opening), and the second end 174 of the base 104 (e.g., integral second end 174*a* of the base 104 as shown in FIG. 1C) comprises the second opening 166 (e.g., bottom opening).

In one embodiment, the first opening 164 and the second opening 166 are positioned to provide unobstructed path for dispensing the product 108. For example, the first opening 164 and the second opening 166 can be located at the top and bottom of the base 104, respectively. The first opening 164 can also be positioned and configured to mate with the container 102 (e.g., the second portion 114 of the container).

In one embodiment, a first portion 118 (e.g., top portion) of the base 104 is adjacent to the container 102 and a second portion 120 (e.g., bottom portion) of the base 104 extends past the dispensing tip (e.g., nozzle 122) of a dispenser 116 on the container 102. Fixing such a base 104 to the container 102 can be useful, for example, to maintain the container 102 in a desired storage configuration (e.g., with the tip or dispenser nozzle 122 pointing down). However, in some embodiments, the dispenser tip does not provide a stable surface for maintaining the container 102 in the desired storage configuration. Accordingly, it can be useful to fix a base 104 to the container, and thereby provide the container 102 with more stability and enable the base 104 to be stored in the desired storage configuration.

In order to provide the base 104 and/or a container 102 with more stability, it can be useful if the second portion 120 (e.g., bottom portion) of the base 104 is wider than the first portion 118 (e.g., top portion) of the base 104. For example, a dimension 168 (e.g., circumference, diameter, length, or width, as applicable) of the bottom end of the base 104 is larger than a maximum dimension 170 of the top portion of the base 104. This can be useful when the first portion 112 (e.g., top portion) of the container 102 is wider than the second portion 114 (e.g., bottom portion) of the container 102.

In one embodiment, the second portion 120 of the base 104 comprises a dimension 168 (e.g., circumference, diameter, length, or width, as applicable) that is at least as large as a maximum corresponding dimension 172 (e.g., circumference, diameter length, or width, as applicable) of the container 102.

In one embodiment, the second portion 120 of the base 104 comprises a dimension 168 (e.g., circumference, diameter length, or width, as applicable) that is at least 80% of the size for a maximum corresponding dimension (e.g., circumference, diameter length, or width, as applicable) of the container 102.

In some embodiments, the base 104 is integral to a container 102. However, in other embodiments, the base 104 is removably or permanently fixed to the container 102. For example, the first portion 118 of the base 104 can be removably fixed to the second portion 114 of the container 102. In one embodiment, the first portion 118 of the base 104 receives the second portion 114 of the container 102 through the first opening 164 of the base 104. For example, the first portion 118 of the base 104 can be sized to encompass, wrap around, and/or fit snugly against the second portion 114 of the container 102.

Additionally, as illustrated, for example, in FIGS. 8 and 8A-8D, in some embodiments, the first portion 118 of the base 104 can comprise a first base lip 802. For example, if the base 104 is removably or permanently fixed to the container 102, the first base lip 802 can provide a surface for supporting the container 102 and/or fixing the base 104 to the container 102. In addition to the first base lip 802, in some embodiments, the base 104 comprises a base flange 804 for supporting the container 102. For example, the first base lip 802 and the base flange 804 can work together to fix a container 102 to a base 104.

In one embodiment, the base 104 is friction fitted to the container 102. For example, a container 102 can comprise a container indentation 806 along the circumference of the container and a container lip 808 along the circumference of the container and adjacent to the container indentation. As illustrated, for example, in FIG. 8, the container 102 comprises a first end 812 and a second end 810, and the container lip 808 is closer to the second end of the container (e.g., bottom end that engages the base 104). Additionally, the base 104 comprises a first base lip 802 positioned along the circumference of the base and oriented to face inwardly. The first base lip 802 is sized to fit over the container lip 808 and is sized to fit snugly within the indentation 806 of the container 102. Accordingly, the base 104 can snap on and off the container 102, thereby providing a base that is removably fixed to the container.

Figure 8:
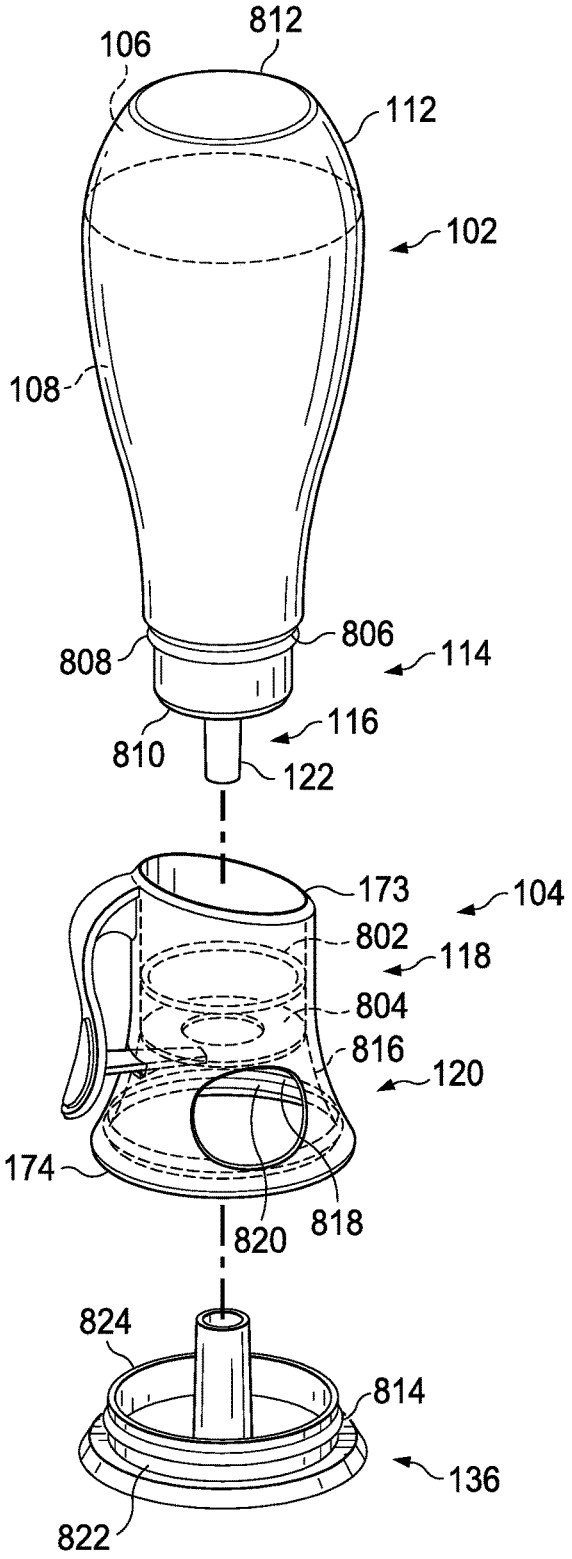
FIG. 8 is a schematic illustration of one embodiment of the invention depicting corresponding ridges and indentations for fixing a base to a container and for fixing a lid to the base.
Figure 8A:
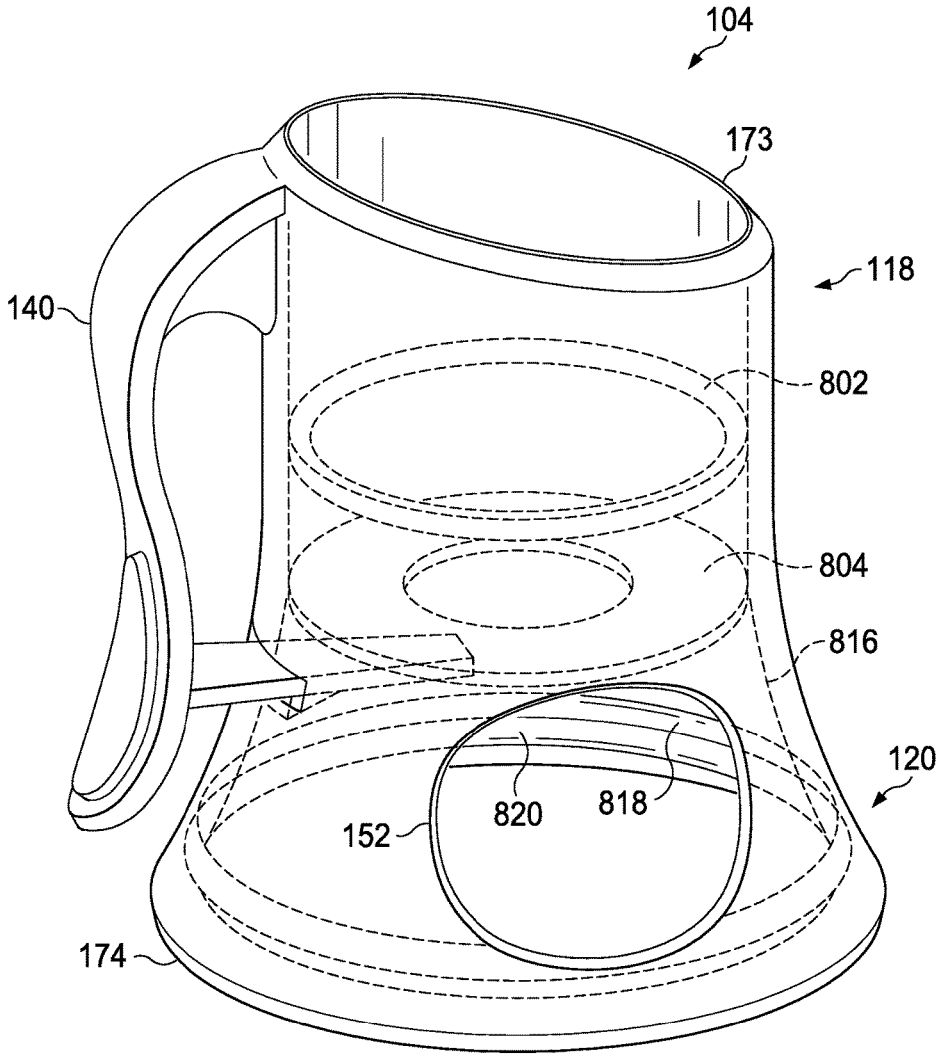
FIG. 8A is a schematic top perspective view of the base shown in FIG. 8.
Figure 8B:
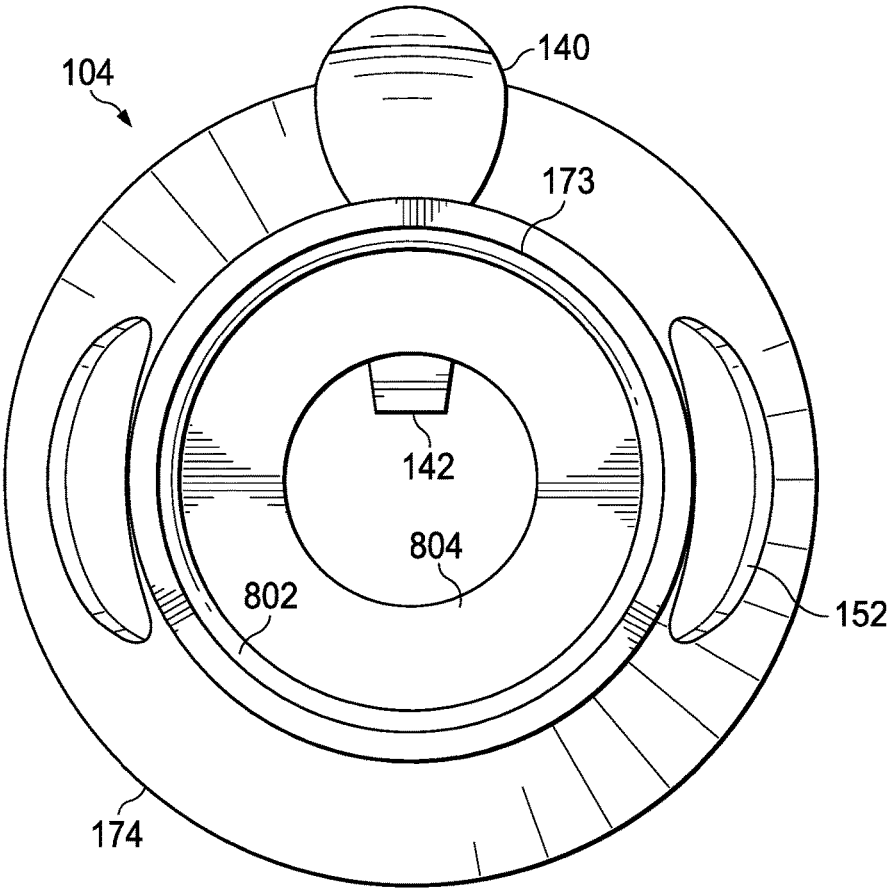
FIG. 8B is a schematic top view of the base shown in FIG. 8.
Figure 8C:
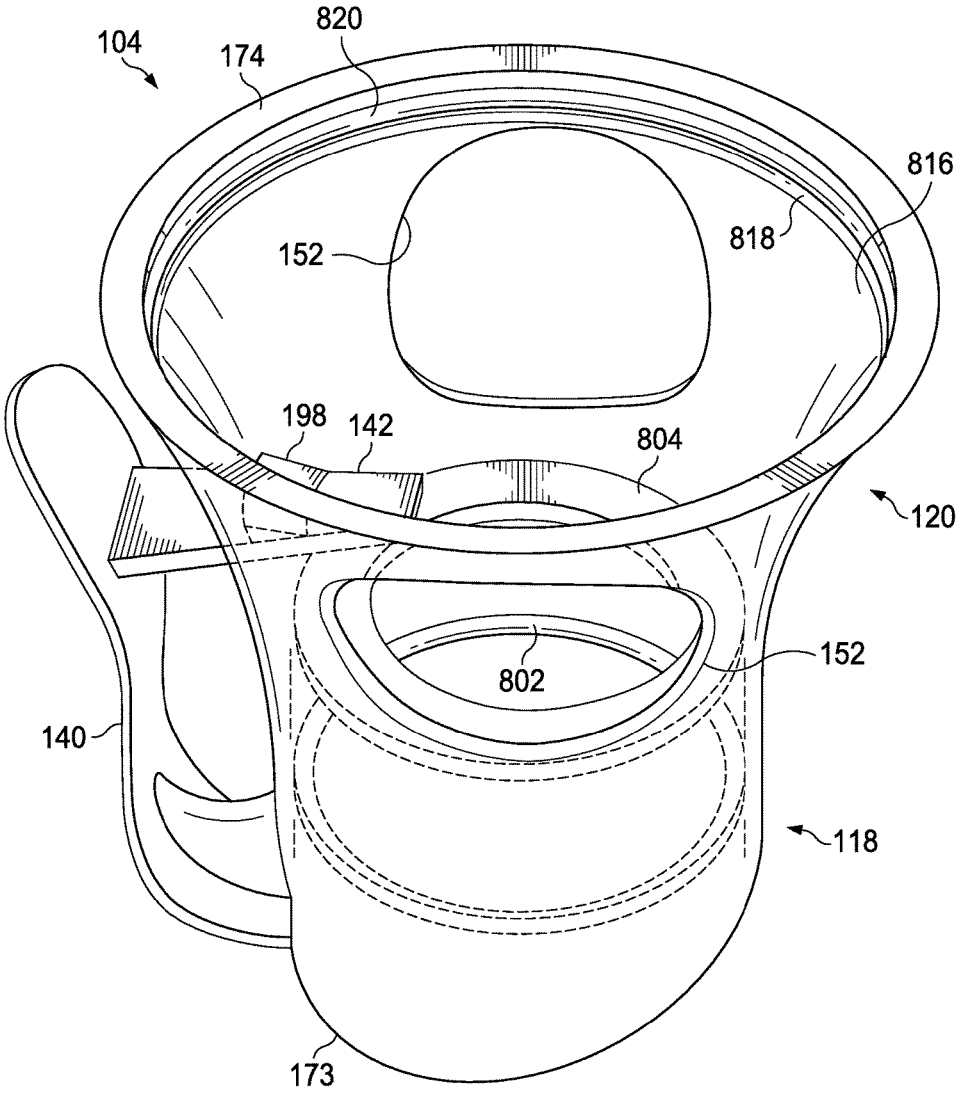
FIG. 8C is a schematic bottom perspective view of the base shown in FIG. 8.
Figure 8D:
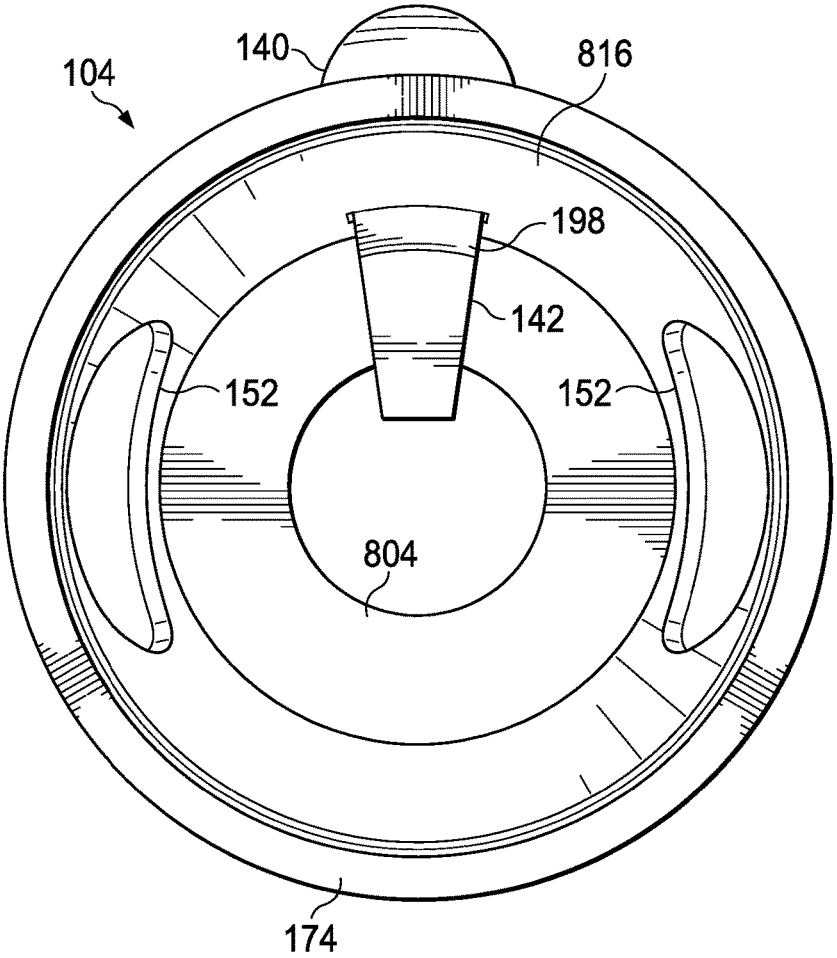
FIG. 8D is a schematic bottom view of the base shown in FIG. 8.

Although, the base 104 can be removably or permanently fixed to the container in other ways as well. For example, rather than having the container protrude into a portion of the base, the base could protrude into a portion of the container, and the position and orientation of the indentation and lips can be modified appropriately. Furthermore, as illustrated in FIG. 8, the base 104 comprises a base flange 804 for supporting a second portion 114 (e.g., second end 810) of the container 102 and preventing the second portion of the container from extending too far past a first end 173 (e.g., top end) of the base. For example, the base flange 804 can be used to stop the second portion 114 of the container (e.g., second end 810) in a position relative to the base 104 such that the dispenser 116 (e.g., nozzle 122) of the container does not extend past a second end 174 (e.g., bottom end) of the base.

Additionally, as illustrated, for example, in FIG. 8, in some embodiments, the lid 136 can comprise a lip 814. For example, if the lid 136 is removably fixed to the base 104, the lip 814 of the lid can provide a surface for fixing the lid to the base.

In one embodiment, the lid 136 is friction fitted to the base 104. For example, an interior wall 816 of the base 104 can comprise a base indentation 818 along the circumference of the base and a second base lip 820 along the circumference of the base and adjacent to the base indentation. As illustrated, for example, in FIG. 8, the base 104 comprises a first end 173 and a second end 174, and the second base lip 820 is closer to the second end of the container (e.g., bottom end that engages the lid 136). Additionally, the lid 136 comprises a lip 814.

As illustrated in FIG. 8, the lip 814 of the lid 136 is positioned along the circumference of a projection 824 of the lid that extends along the base (e.g., protrudes into the interior wall 816 of the base). Although, other configurations are also possible. For example, the base 104 could protrude into the lid 136, and the position and orientation of the indentation and lips can be modified appropriately.

As illustrated in FIG. 8, the lip 814 of the lid 136 is sized to fit inside the second base lip 820 and is sized to fit snugly within the second base indentation 818. Accordingly, the lid 136 can snap on and off the base 104, thereby providing a lid that is removably fixed to the base. Although, the lid 136 can be removably fixed to the base in other ways as well.

Furthermore, as illustrated in FIG. 8, the lid 136 comprises a junction 822 for mating with the second end 174 of the base 104. The junction 822 of the lid 136 and the projection 824 of the lid guide the lid 136 to and maintain the lid in a desired position relative to the base 104, which can be, for example, a storage configuration. As an illustration, when the base 104 is already fixed to the container 102, and the lid 136 is subsequently attached to the base 104, the projection 824 of the lid, the junction 822 of the lid and the second end 174 of the base can prevent the base from being pushed against and damaging and/or actuating the dispenser 116 (e.g., nozzle 122) of the container 102.

Although the container 102 and the lid 136 have been illustrated as being fixed to the base 104 using a specific configuration of components (e.g., lips and indentations), other structures and configurations can also be used to fix the container and/or lid to the base.

With reference to FIG. 1A, in some embodiments, the second portion 120 of the base 104 comprises a second opening 166 or a second opening 166 and a lid 136. In one embodiment, the base 104 (e.g., the second portion 120 of the base 104) comprises a removable lid 136. The lid 136 can be used to separate a dispenser 116 from a supporting surface 134 upon which the base 104 rests. This can prevent tainting of the product, contamination of the dispenser, and dripping or leakage of the product onto the supporting surface 134 (e.g., a display shelf, refrigerator shelf, or countertop). Furthermore, the lid 136 can comprise a safety mechanism 138 to prevent actuation of the dispenser 116 while the lid 136 is engaged (e.g., with the base 104 and/or the dispenser 116). The lid 136 can also be a tamper-evident lid or an anti-tamper lid. Depending on whether or not a lid 136 is fixed (e.g., attached) to a base 104, the location of the second end 174 (e.g., the effective second end) of the base 104 can change. For example, FIG. 1C shows the location of the integral second end 174*a* of the base 104 and the location of a non-integral second end 174*b*. As can be seen, by fixing a lid to the integral second end 174*a*, a non-integral second end 174*b* is provided. Furthermore, fixing a lid to the integral second end 174*a* effectively changes the location of the second end 174 of the base 104 from the integral second end 174*a* to the non-integral second end 174*b*.

Figure 6B:
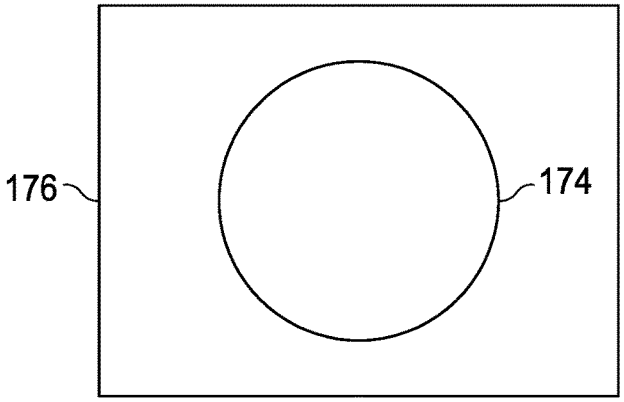
FIG. 6B is a schematic illustration of one embodiment of the invention depicting a cross-sectional view of the bottom end of the base shown in FIG. 6A, with the cross-section being taken along the plane shown in FIG. 6A.

In some embodiments, as shown in FIGS. 6A-6B, the second portion 120 of the base 104 can comprise a second end 174 (e.g., bottom end) with a substantially continuous, planar cross-section. For example, if a cross-section of the base 104 were taken along a plane 176 that passes through the bottom end 174 of the base 104, the base 104 would be continuous or substantially continuous in the plane 176. If the base 104 has a rounded bottom end 174 (e.g., bottom end with portions that comprise a circular or elliptical cross-section) it can be advantageous for the base 104 to comprise a continuous or substantially continuous bottom end 174 as shown in FIGS. 6A-6B.

Figure 7A:
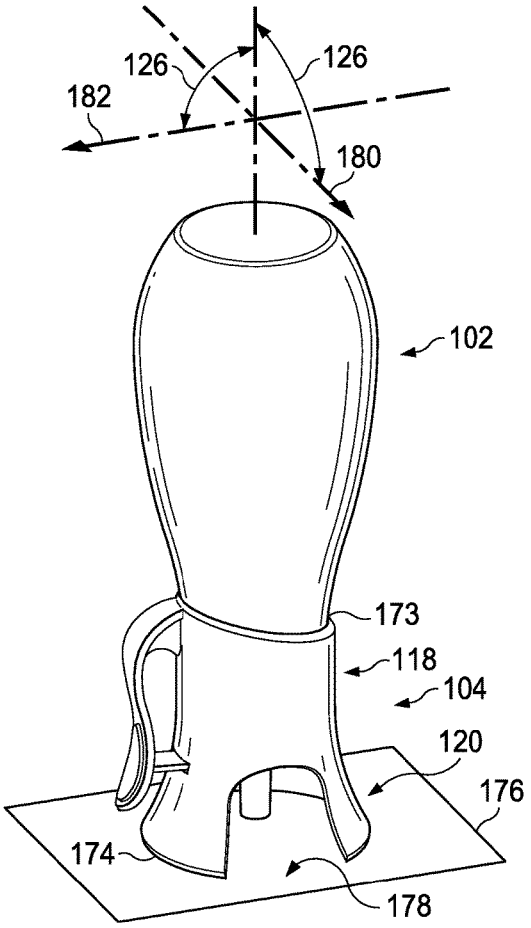
FIG. 7A is a schematic illustration of one embodiment of the invention depicting a container joined to a base, depicting a bottom end of the base comprising a discontinuity, and depicting a plane for taking a cross-section of the bottom end.
Figure 7B:
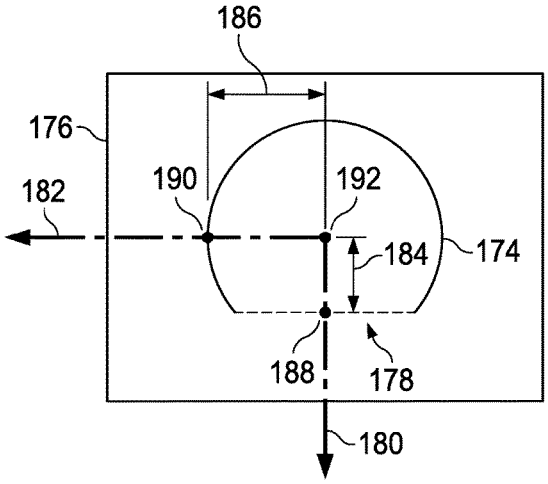
FIG. 7B is a schematic illustration of one embodiment of the invention depicting tipping points for the base and container of FIG. 7A superimposed on a cross-sectional view of the bottom end of the base, with the cross-section being taken along the plane shown in FIG. 7A.

The usefulness of a continuous or substantially continuous bottom end 174 can be seen by comparison to a base 104 comprising a substantial discontinuity 178 in the bottom end 174 as illustrated in FIGS. 7A-7B. If a container 102 is fixed to a base 104 with a rounded bottom end 174, a discontinuity 178 in the bottom end 174 decreases the container's maximum, stable angle of tilt 126 in the direction 180 of the discontinuity. As used in this context, the maximum stable, angle of tilt 126 for a container 102 and a base 104 in a direction (e.g., a first direction 180 or a second direction 182) is the maximum angle at which the container 102 can tilt in the direction such that the force of gravity provides a torque that tends to move the container 102 and base 104 into a storage configuration (e.g., with the container 102 resting on the base 104 and the second end of the base 104 resting on a supporting surface 134 in a state of static equilibrium).

An example is illustrated in FIG. 7B, if a container 102 tilts in direction 180, when the center of mass of the container 102 is over the first tipping point 188, the container will be unstable and tend to fall over rather than return to a storage configuration with the container resting on the base. Similarly, if the container 102 tilts in a direction 182 where the base does not have discontinuity, when the center of mass of the container 102 is over the second tipping point 190, the container will be unstable and tend to fall over under the force of gravity. A first distance 184 represents the distance from an original location 192 of the container's center of mass to the first tipping point 188. A second distance 186 represents the distance from the original location 192 of the container's center of mass to the second tipping point 190. As can be seen in FIG. 7B, the first distance 184 is smaller than the second distance 186. Accordingly, given a container with a rounded bottom end 174, the maximum angle of tilt 126 for the container 102 in the direction 180 of the discontinuity 178 in the bottom end 174 is smaller than the maximum angle of tilt 126 in a direction 182 where the bottom end 174 of the base does not have a discontinuity. In contrast, for bottom ends comprising shapes with linear edges between vertices, discontinuities along the linear portion of the edge do not reduce the maximum, stable angle of tilt 126 of the container 102.

Turning again to FIG. 1B, one embodiment of the invention comprises a window 152. For example, as shown, the window 152 provides a fully or substantially unobstructed line of sight 151 (e.g., path for visible light) from a point 153 outside the base 104 to the interior 146 of the base. Accordingly, a window 152 can be sized to enable a user to view the interior 146 of the base 104 or to enable light to reach the interior 146 of the base 104. For example, in one embodiment, a dimension 194 (e.g., length, width, or diameter, as applicable) across the window 152 (or some or all of a plurality of windows 152) is at least at least 1 cm.

As illustrated in FIG. 5B, a window 152 (or plurality of windows 152) can be used, for example, to light or view the interior 146 of the base 104 while product 108 is being dispensed or while the base 104 is being cleaned. As can be seen by reference to FIGS. 1A-1B, while the interior 146 of the base 104 is viewed and/or lit through a first window 152, the base 104 can be cleaned through a second window 152, through a first opening 164 in the first portion 118 (e.g., top portion) of the base 104, or through a second opening 166 in the second portion 120 (e.g., bottom portion) of the base 104.

A window 152 can be especially useful, for example, when the base 104 is attached to the container 102 so that the first opening 164 in the first portion 118 (e.g., top portion) of the base 104 is unavailable for viewing or lighting the interior 146 of the base 104, and/or when a user is cleaning the interior 146 of the base 104 through the second opening 166 in the second portion 120 (e.g., bottom portion) of the base 104. As another example, a window 152 can be useful when a user is manually cleaning the interior 146 of the base 104 through an opening (e.g., a window 152, the first opening 164, and/or the second opening 166). For example, a hand or other object can block the opening, obstruct the path of light through the opening, and block the user's line of sight through the opening. A hand or object can also block the user's line of sight to the interior 146 of the base 104. Furthermore, if a user were to place a light-emitting device (e.g., flash light) between the user and the base 104, so that light can reach the interior 146 of the base 104, the light-emitting device could block the user's line of sight to the interior 146 of the base 104. In all of these circumstances, it can be advantageous for a base 104 to comprise at least one window 152 and even more advantageous for a base 104 to comprise at least two windows 152 through which to view and/or shine light on the interior 146 of the base 104.

In addition to a window 152 (or in place of a window 152), the base 104 can also comprise a transparent material positioned to provide a line of sight from the exterior 144 of the base 104 to the interior 146 of the base 104 while the base 104 is joined to the container 102. In one embodiment, the base 104 comprises a light-passing portion of the base (e.g., window 152). The light-passing portion of the base can comprise an opening, transparent material or translucent material and can be positioned to provide a path for light to pass from the exterior 144 of the base 104 to the interior 146 of the base 104 while the base 104 is joined to the container 102. Using a transparent material can be useful, for example, when using a window 152 would be useful. Although, since windows 152 can comprise openings, in some embodiments, windows can have an added benefit of providing an opening through which the interior 146 of the base can be cleaned.

With reference to FIGS. 5A-B, one embodiment of the base 104 comprises an actuator 140 (e.g., a trigger) for the dispenser 116. For example, with reference to FIGS. 5A-5B, the actuator 140 can comprise a lever 196 fixed to an extension 142. As shown, the lever 196 and extension 142 are integral. Additionally, the actuator 140 is integral to the base 104.

In one embodiment, when the lever 196 is moved toward the dispenser 116, it moves the extension 142 into contact with the dispenser 116 (e.g., the nozzle 122 of a tilt valve 110) and the contact actuates the dispenser 116, which enables the contents (e.g., the product 108 and/or propellant) of the container 102 to be dispensed (e.g., by opening the tilt valve 110).

In some embodiments, moving the actuator 140 (e.g., by pushing the actuator 140) from a disengaged configuration (see, e.g., FIG. 5A) to an engaged configuration (see, e.g., FIG. 5B) results in tension in the actuator 140. Accordingly, when the actuator 140 is released, a force moves the actuator 140 from the engaged configuration back to the disengaged configuration until the tension is relieved.

In some embodiments, the actuator 140 is under tension and the tension results in a force that tends to move the actuator 140 away from the dispenser 116 until a mechanical stop 198 engages. For example, in one embodiment, the actuator 140 comprises a lever 196 made from a flexible material and the flexible material is placed under tension. In some embodiments, the actuator is made from the same material as other parts of the base. Furthermore, in some embodiments, the entire base, including the actuator, is made from the same material.

Figure 4A:
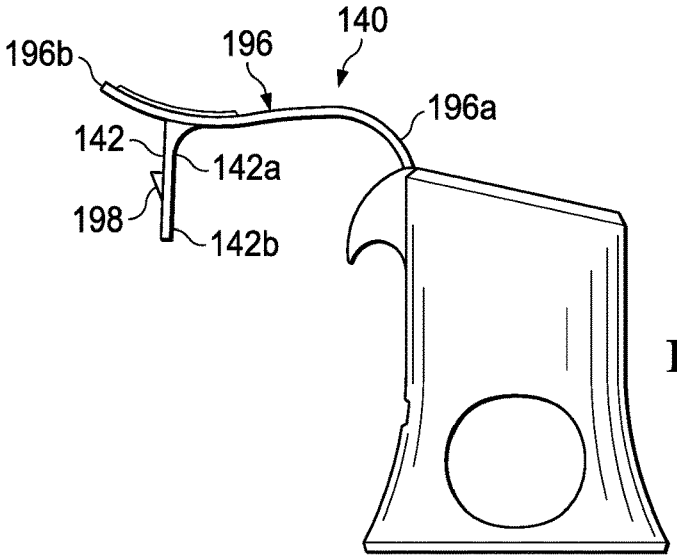
FIG. 4A is a schematic illustration of one embodiment of the invention depicting a base with an actuator in a non-tensed configuration.
Figure 4B:
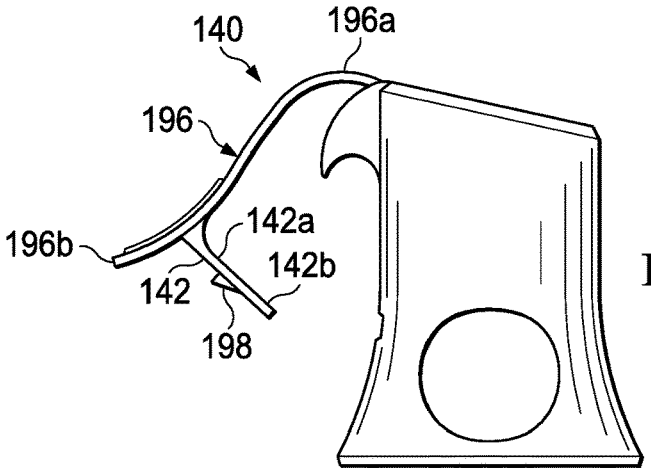
FIG. 4B is a schematic illustration of one embodiment of the invention depicting a base with an actuator flexed to provide an intermediate tensed configuration.
Figure 4C:
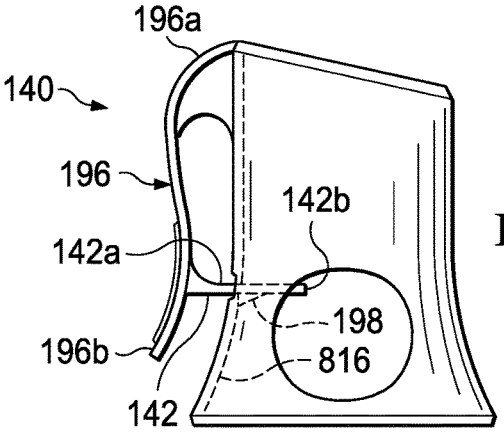
FIG. 4C is a schematic illustration of one embodiment of the invention depicting a base with an actuator flexed to provide a tensed configuration.

As illustrated in FIG. 5, the actuator is formed (e.g., molded) with the trigger in a non-tensed configuration. A force is applied to the lever 196 to bend the lever 196 from a non-tensed (e.g., FIG. 4A) or less-tensed (e.g., FIG. 4B) configuration to a more-tensed configuration (e.g., FIG. 4C). A first end 196*a* of the lever 196 is fixed to the sidewall 148 of the base 104. A second end 196*b* of the lever 196 is fixed to a first end 142*a* of an extension 142. As the actuator 140 is bent into the more-tensed configuration, a second end 142*b* of the extension 142 passes through an opening in the side wall of the base 104. The second end 142*b* of the extension 142 comprises a mechanical stop 198 (e.g., a hook or catch). When the force that is applied to bend the lever 196 is removed, a force provided by the tension in the lever 196 moves the lever 196 toward the non-tensed configuration. However, when the mechanical stop 198 contacts the sidewall 148 of the base 104 (e.g., interior wall 816), the mechanical stop 198 prevents the lever 196 from being able to return to the non-tensed configuration. In one embodiment, the position and/or orientation of the actuator 140 when it is stopped by the mechanical stop 198 provides a disengaged configuration of the actuator 140.

As shown in FIGS. 5A-5B, when the lever 196 of the actuator 140 is pressed, the extension 142 of the actuator 140 moves toward the dispenser 116 and into contact with the dispenser 116. The contact displaces the dispenser 116 and actuates the dispenser 116 to dispense the contents of the container 102. The position and orientation of the actuator 140 when the dispenser 116 is actuated provides an engaged configuration of the actuator 140.

In some embodiments, when the actuator 140 is in the engaged configuration, a tension in the lever 196 of the actuator 140 provides a force to move the actuator 140 back to the disengaged configuration of the actuator 140. Although the invention has been described using a tension in the actuator 140 and a mechanical stop 198 to maintain the actuator 140 in a disengaged configuration, other devices can also be used for the same purpose. For example, a spring can be used to provide a force to move the actuator 140 and a different type of mechanical stop 198 can be used.

Additionally in some embodiments, the lever 196 of the actuator 140 comprises a pad 161, for example, as shown in FIGS. 1A and 5A. Among other uses, the pad 161 can provide a cushion to help reduce fatigue and/or soreness associated with repeatedly or continuously pressing the actuator 140. The pad can also comprise a surface for providing a desired (e.g., increased) degree of friction between the actuator 140 and an actuating object (e.g., a user's finger) and to prevent the actuating object from slipping against the actuator.

Although a base 104 according to the invention can be made from various materials and using various processes, certain materials and manufacturing processes can be advantageous. For example, in one embodiment, the base 104 is made using an injection molding process. Furthermore, in some embodiments, the base 104 comprises, consists of, or consists essentially of a polymer (e.g., PE, PP, PVC, ABS, PS, PET, Nylon, PMMA, or blends thereof and/or metal (e.g., aluminum, tin, or steel.

Although the term head space can mean a volume of gas at the top of a container over a solid or liquid also stored in the container, as used herein, the term head space also refers generally to an undissolved gaseous phase in a container that will tend to move to the top of the container, even if, for example, as a result of a disturbance, the gaseous phase is not presently at the top of the container.

Additional Embodiments

The following clauses are offered as further description of the disclosed invention:

1. A base for a container of a viscous product and a propellant; wherein the propellant forms a head space; wherein the container comprises a first portion and a second portion opposite the first portion of the container; wherein the second portion of the container comprises a dispenser; wherein, when the base and the container are in a storage configuration, the second portion of the container is adjacent to the base, the container rests on the base, the base rests on a surface, and the product and the propellant in the head space tend to move toward positions wherein the propellant in the head space is at a higher elevation than the product and the product is at a higher elevation than an inlet to the dispenser; said base comprising:

a first portion of the base, wherein the first portion of the base comprises a first end of the base;

a second portion of the base, wherein the second portion of the base comprises an integral second end of the base, and wherein the integral second end of the base is opposite the first end of the base;

a sidewall between the first end of the base and the integral second end of the base, wherein the sidewall comprises an interior surface of the sidewall; and an interior of the base, wherein the interior of the base comprises the interior surface of the sidewall and any point between two points on the interior surface of the sidewall;

wherein the first end of the base comprises a first opening of the base;

wherein the integral second end of the base comprises a second opening of the base; and wherein the sidewall comprises a window positioned to provide a line of sight from a point outside the base to the interior of the base.

2. The base of clause 1 or 16, further comprising:

a transparent material positioned to provide a line of sight from a point outside the base to the interior of the base while the base is joined to the container.

3. The base of clause 1 or 16, further comprising:

a translucent material positioned to provide a path for light to pass from a point outside the base to the interior of the base while the base is joined to the container.

4. The base of clause 1 or 16, further comprising:

a removable lid.

5. The base of clause 1 or 16, wherein the lid comprises a safety mechanism to prevent actuation of the dispenser while the lid is engaged with the base and the dispenser.

6. The base of clause 1 or 16, wherein the second portion of the base comprises the removable lid.

7. The base of clause 1 or 16, further comprising:

an actuator for the dispenser.

8. The base of clause 1 or 16, further comprising:

a tamper-evident lid.

9. The base of clause 1 or 16, wherein the base is integral to the container.

10. The base of clause 1 or 16, wherein the base is removably fixed to the container.

11. The base of clause 1 or 16, wherein the second portion of the base is wider than the first portion of the base.

12. The base of clause 1 or 16, wherein the first portion of the base is removably fixed to the second portion of the container.

13. The base of clause 1 or 16, wherein the first portion of the base receives the second portion of the container through the first opening of the base.

14. The base of claim 1, wherein the first portion of the base comprises a lip.

15. The base of clause 1 or 16, wherein the integral second end of the base has a substantially continuous cross-section.

16. A base for a container of a viscous product and a propellant; wherein the propellant forms a head space; wherein the container comprises a first portion and a second portion opposite the first portion of the container; wherein the second portion of the container comprises a dispenser; wherein, when the base and the container are in a storage configuration, the second portion of the container is adjacent to the base, the container rests on the base, the base rests on a surface, and the product and the propellant in the head space tend to move toward positions wherein the propellant in the head space is at a higher elevation than the product and the product is at a higher elevation than an inlet to the dispenser; said base comprising:

a first portion of the base, wherein the first portion of the base comprises a first end of the base;

a second portion of the base, wherein the second portion of the base comprises an integral second end of the base, and wherein the integral second end of the base is opposite the first end of the base;

a sidewall between the first end and the integral second end, wherein the sidewall comprises an interior surface of the sidewall; and an interior of the base, wherein the interior of the base comprises the interior surface of the sidewall and any point between two points on the interior surface of the sidewall;

wherein the first end of the base comprises a first opening of the base;

wherein the integral second end of the base comprises a second opening of the base; and wherein the second portion of the base comprises a lid.

17. A method for storing and dispensing a viscous product; wherein the product and a propellant are stored in a container on a base; wherein the propellant forms a head space;

wherein the container comprises a first portion and a second portion opposite the first portion of the container; wherein the second portion of the container comprises a dispenser; wherein the container is configured to dispense the product when the propellant in the head space is at a higher elevation than the product and the product is at a higher elevation than an inlet to the dispenser; wherein the base comprises a first portion and a second portion opposite the first portion of the base; wherein the first portion of the base comprises a first end of the base; wherein the second portion of the base comprises an integral second end of the base; and wherein the integral second end of the base is opposite the first end of the base; said method comprising:

storing the container in a storage configuration on the base; wherein the container rests on the base, the base rests on a surface, and the product and the propellant in the head space tend to move toward positions wherein the propellant in the head space is at a higher elevation than the product and the product is at a higher elevation than the inlet to the dispenser; removing a lid from the base to expose the dispenser; and dispensing the product.

18. The method of clause 17 or 31, further comprising: moving a tamper evident seal into a configuration that indicates the container has been opened.

19. The method of clause 17 or 31, further comprising: disengaging a safety mechanism.

20. The method of clause 17 or 31, further comprising: pressing an actuator on the base to actuate the dispenser.

21. The method of clause 17 or 31, further comprising: cleaning an interior of the base.

22. The method of clause 17 or 31, further comprising: cleaning an interior of the base through an opening in a sidewall of the base.

23. The method of clause 17 or 31, further comprising: cleaning an interior of the base through an opening in the second portion of the base.

24. The method of clause 17 or 31, further comprising: lighting an interior of the base through a light-passing portion of the base, wherein the light-passing portion of the base is selected from the group consisting of an opening, a transparent portion, and a translucent portion.

25. The method of clause 17 or 31, further comprising: applying a lid to the base.

26. The method of clause 17 or 31, further comprising: engaging a safety mechanism on the base to prevent actuation of the dispenser.

27. The method of clause 17 or 31, further comprising: positioning the base on a surface.

28. The method of clause 17 or 31, further comprising: fixing the base to the container.

29. The method of clause 17 or 31, further comprising: removing the base from the container.

30. The method of clause 17 or 31, further comprising: removing the base from the container and fixing the base to another container.

31. A method for storing and dispensing a viscous product; wherein the product and a propellant are stored in a container on a base; wherein the propellant forms a headspace; wherein the container comprises a first portion and a second portion opposite the first portion of the container; wherein the second portion of the container comprises a dispenser; wherein the container is configured to dispense the product when the propellant in the head space is at a higher elevation than the product and the product is at a higher elevation than an inlet to the dispenser; wherein the base comprises a first portion and a second portion opposite the first portion of the base; wherein the first portion of the base comprises a first end of the base; wherein the second portion of the base comprises an integral second end of the base; and wherein the integral second end of the base is opposite the first end of the base; said method comprising:

storing the container in a storage configuration on the base, wherein the container rests on the base, the base rests on a surface, and the product and the propellant in the head space tend to move toward positions wherein the propellant in the head space is at a higher elevation than the product and the product is at a higher elevation than the inlet to the dispenser;

dispensing the product; and viewing an interior of the base through a window in a sidewall of the base, wherein the window provides a line of sight from a point outside the base to the interior of the base.

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. An apparatus comprising:

a viscous product;

a propellant;

a container that contains the viscous product and the propellant, wherein the propellant forms a head space in the container, and a base for the container;

wherein the container comprises a first portion and a second portion opposite the first portion of the container; wherein the second portion of the container comprises a dispenser;

wherein the base and the container are configured so that, when the base and the container are in a storage configuration, the second portion of the container is adjacent to the base, the container rests on the base, the base rests on a surface, and the viscous product and the propellant in the head space tend to move toward positions wherein the propellant in the head space is at a higher elevation than the viscous product and the viscous product is at a higher elevation than an inlet to the dispenser;

wherein the base comprises:

a first portion of the base, wherein the first portion of the base comprises a first end of the base;

a second portion of the base, wherein the second portion of the base comprises an integral second end of the base, and wherein the integral second end of the base is opposite the first end of the base;

a sidewall between the first end of the base and the integral second end of the base, wherein the sidewall comprises an interior surface of the sidewall;

an interior of the base, wherein the interior of the base comprises the interior surface of the sidewall and any point between two points on the interior surface of the sidewall;

a lid, wherein the lid is removable and wherein the lid comprises a safety mechanism to prevent actuation of the dispenser while the lid is engaged with the base and the dispenser; and an actuator for the dispenser;

wherein the first end of the base comprises a first opening of the base; and wherein the integral second end of the base comprises a second opening of the base.

2. The apparatus of claim 1, wherein the sidewall comprises a window positioned to provide a line of sight from a point outside the base to the interior of the base.

3. The apparatus of claim 1, wherein the first portion of the base is fixed to the second portion of the container and the second portion of the base is configured to extend away from the first portion of the base and past a dispensing tip of the dispenser.

4. The apparatus of claim 1, wherein the sidewall comprises a window positioned to provide a line of sight from a point outside the base to the interior of the base.

5. The apparatus of claim 1, wherein the apparatus comprises:

a transparent material positioned to provide a line of sight from a point outside the base to the interior of the base while the base is joined to the container.

6. The apparatus of claim 1, wherein the second portion of the base comprises the lid.

7. The apparatus of claim 1, wherein the dispenser comprises a valve for dispensing the viscous product; and wherein the actuator comprises an extension configured to be moved into contact with the dispenser, thereby actuating the valve to dispense the viscous product.

8. The apparatus of claim 1, wherein the lid is a tamper-evident lid.

9. The apparatus of claim 1, wherein the base is integral to the container.

10. The apparatus of claim 1, wherein the base is removably fixed to the container.

11. The apparatus of claim 1, wherein the first portion of the base is fixed to the second portion of the container; and wherein the second portion of the base is wider than the first portion of the base.

12. The apparatus of claim 11, wherein the first portion of the base is removably fixed to the second portion of the container.

13. The apparatus of claim 12, wherein the first portion of the base receives the second portion of the container through the first opening of the base.

14. The apparatus of claim 13, wherein the first portion of the base comprises a lip.

15. The apparatus of claim 13, wherein the integral second end of the base has a continuous cross-section.

16. A method for storing and dispensing a viscous product; wherein the viscous product and a propellant are stored in a container on a base; wherein the propellant forms a head space; wherein the container comprises a first portion and a second portion opposite the first portion of the container; wherein the second portion of the container comprises a dispenser; wherein the container is configured to dispense the viscous product when the propellant in the head space is at a higher elevation than the viscous product and the viscous product is at a higher elevation than an inlet to the dispenser; wherein the base comprises a first portion, a second portion opposite the first portion of the base, a sidewall, an interior of the base, a lid, and an actuator for the dispenser; wherein the first portion of the base comprises a first end of the base; wherein the second portion of the base comprises an integral second end of the base; wherein the integral second end of the base is opposite the first end of the base; wherein the sidewall is between the first end of the base and the integral second end of the base; wherein the sidewall comprises an interior surface of the sidewall; and wherein the interior of the base comprises the interior surface of the sidewall and any point between two points on the interior surface of the sidewall; said method comprising:

storing the container in a storage configuration on the base, wherein the container rests on the base, the base rests on a surface, and the viscous product and the propellant in the head space tend to move toward positions wherein the propellant in the head space is at a higher elevation than the viscous product and the viscous product is at a higher elevation than the inlet to the dispenser;

removing the lid from the base to expose the dispenser before dispensing the viscous product, wherein the lid comprises a safety mechanism to prevent actuation of the dispenser while the lid is engaged with the base and the dispenser; and pressing the actuator on the base to actuate the dispenser and thereby dispense the viscous product.

17. The method of claim 16, wherein the sidewall comprises a window positioned to provide a line of sight from a point outside the base to the interior of the base; and wherein the method comprises:

viewing the interior of the base through the window in the sidewall of the base.

18. The method of claim 16, wherein the lid comprises a tamper evident seal; and wherein the method comprises:

moving the tamper evident seal into a configuration that indicates the container has been opened.

19. The method of claim 16, wherein the method comprises:

cleaning the interior of the base.

20. The method of claim 17, wherein the method comprises:

cleaning the interior of the base through the window in the sidewall of the base.

21. The method of claim 16, wherein the method comprises:

cleaning the interior of the base through an opening in the second portion of the base.

22. The method of claim 16, wherein the method comprises:

lighting the interior of the base through a light-passing portion of the base, wherein the light-passing portion of the base is selected from the group consisting of an opening, a transparent portion, and a translucent portion.

23. The method of claim 16, wherein the method comprises:

applying the lid to the base after dispensing the viscous product.

24. The method of claim 23, wherein the applying the lid to the base engages the safety mechanism on the base to prevent the actuation of the dispenser.

25. The method of claim 23, wherein the method comprises:

positioning the base on a surface after applying the lid to the base.

26. The method of claim 16, wherein the method comprises:

removing the base from the container.

27. The method of claim 26, wherein the method comprises:

fixing the base to the container.

28. The method of claim 16, wherein the method comprises:

removing the base from the container and fixing the base to another container.

29. The method of claim 16, wherein the first portion of the base is fixed to the second portion of the container and the second portion of the base is configured to extend away from the first portion of the base and past a dispensing tip of the dispenser.

30. The method of claim 16, wherein the first portion of the base is fixed to the second portion of the container and the second portion of the base is wider than the first portion of the base.

31. The method of claim 30, wherein the first portion of the base is removably fixed to the second portion of the container.

32. The apparatus of claim 1, wherein the viscous product has a viscosity equal to 1000 to 250,000 cP at conditions present in the container.

33. The apparatus of claim 1, wherein the dispenser comprises a tilt valve having a nozzle;

wherein the safety mechanism comprises a safety sheath;

wherein the apparatus is configured so that while the lid is applied to the base, the safety sheath covers the nozzle of the tilt valve and prevents the nozzle from being displaced, thereby preventing the nozzle from dispensing the viscous product or the propellant from the container; and wherein the apparatus is configured so that when the lid is removed from the base, the safety sheath is disengaged from the nozzle and does not prevent the nozzle from being displaced and thereby dispensing the viscous product or the propellant from the container.

34. The apparatus of claim 1, wherein the actuator comprises a lever and an extension;

wherein the lever comprises a first end of the lever and a second end of the lever;

wherein the extension comprises a first end of the extension, a second end of the extension, and a mechanical stop;

wherein the first end of the lever is fixed to the sidewall of the base, the second end of the lever is fixed to the first end of the extension, and the second end of the extension comprises the mechanical stop;

wherein the extension extends through an opening in the sidewall and the extension extends from outside the sidewall of the base to inside the interior of the base;

wherein a force on the lever urges the mechanical stop into contact with the interior surface of the sidewall of the base, thereby providing a disengaged position of the actuator.

35. The method of claim 16, wherein the viscous product has a viscosity equal to 1000 to 250,000 cP at conditions present in the container.

36. The method of claim 16, wherein the dispenser comprises a tilt valve having a nozzle;

wherein the safety mechanism comprises a safety sheath;

wherein the base and the container are configured so that while the lid is applied to the base, the safety sheath covers the nozzle of the tilt valve and prevents the nozzle from being displaced, thereby preventing the nozzle from dispensing the viscous product or the propellant from the container; and wherein the base and the container are configured so that when the lid is removed from the base, the safety sheath is disengaged from the nozzle and does not prevent the nozzle from being displaced and thereby dispensing the viscous product or the propellant from the container.

37. The method of claim 16, wherein the actuator comprises a lever and an extension;

wherein the lever comprises a first end of the lever and a second end of the lever;

wherein the extension comprises a first end of the extension, a second end of the extension, and a mechanical stop;

wherein the first end of the lever is fixed to the sidewall of the base, the second end of the lever is fixed to the first end of the extension, and the second end of the extension comprises the mechanical stop;

wherein the extension extends through an opening in the sidewall and the extension extends from outside the sidewall of the base to inside the interior of the base;

wherein a force on the lever urges the mechanical stop into contact with the interior surface of the sidewall of the base, thereby providing a disengaged position of the actuator.

* * * * *